US005505033A

United States Patent [19]

Matsuo et al.

[11] Patent Number: 5,505,033

[45] Date of Patent: Apr. 9, 1996

[54] COLUMN BASE STRUCTURE AND CONNECTION ARRANGEMENT

[75] Inventors: Hideshige Matsuo; Nobukiyo Imagawa; Isamu Yamamoto; Michio Itoh, all of Kitakyushu; Kuniaki Sato, Hiratuka, all of Japan

[73] Assignee: 501 Hitachi Metals Ltd., Tokyo, Japan

[21] Appl. No.: 687,727

[22] Filed: Apr. 19, 1991

Related U.S. Application Data

[63] Continuation-in-part of Ser. No. 280,744, Dec. 6, 1988.

[51] Int. Cl.[6] ..... F02D 27/42

[52] U.S. Cl. ..... 52/296; 52/169.9; 52/295

[58] Field of Search ..... 52/295, 296, 292, 52/294, 169.9

[56] References Cited

U.S. PATENT DOCUMENTS

| | | | |
|---|---|---|---|
| 1,334,519 | 3/1920 | Bushong | 52/295 |
| 1,529,895 | 3/1925 | Chance et al. | 52/296 |
| 1,725,507 | 8/1929 | Clement | 52/295 |
| 3,319,391 | 5/1967 | Lutch | 52/295 |
| 3,837,752 | 9/1974 | Shewchuk | 52/295 |
| 4,136,811 | 1/1979 | Sato | 52/296 |
| 4,306,397 | 12/1981 | Ramseyer | 52/295 |
| 4,469,956 | 9/1984 | D'Amato | 52/296 |
| 5,063,719 | 11/1991 | Matsuo et al. | 52/296 |

*Primary Examiner*—Michael Safavi
*Attorney, Agent, or Firm*—McGlew and Tuttle

[57] ABSTRACT

A column base structure formed by integrally joining a column base metal fitting having a raised portion and a base plate to a steel-frame column, and joining the column base metal fitting joined to the steel-frame column to a concrete foundation via anchor bolts embedded in the concrete foundation, in which an anchor-bolt retainer having an upper anchor plate and a lower anchor plate is fixedly fitted to support members installed on a concrete subslab, anchor bolts are hold in position via the anchor-bolt retainer, and the anchor bolts are embedded, together with the anchor-bolt retainer, into the concrete foundation.

1 Claim, 14 Drawing Sheets

COLUMN BASE STRUCTURE AND CONNECTION ARRANGEMENT

CROSS REFERENCE TO RELATED APPLICATION

This is a continuation-in-part application of application Ser. No. 07/280,744 filed Dec. 6, 1988.

BACKGROUND OF THE INVENTION

This invention relates to a column base structure and a steel-frame structure, or a steel-frame/reinforced concrete structure, or a combined steel-frame and steel-frame/reinforced concrete structure.

DESCRIPTION OF PRIOR ART

The construction accuracy of a steel-frame structure depends largely on the positioning accuracy of steel-frame columns on the lowermost story, which are in turn greatly affected by the accuracy of the foundation structure. Since shop-assembled steel-frame members are usually brought into the construction site within tolerances, errors in on-the-site steel-frame erection are often affected directly by the accuracy of the anchor bolts. As a result, the quality of the erection of a steel-frame structure depends solely on the accuracy of the anchor bolts. For this reason, an anchor bolt fixing device in which anchor bolts are held in position via a steel frame or an anchor retainer is usually used to prevent the anchor bolts from unwantedly moving due to the impacts applied by the pressure of concrete during concrete placement, as described on page 625 of Technical Guide for Steel-frame Construction with Detailed Description (Architectural Institute of Japan, Apr. 25, 1979) published in Japan.

FIG. 1 is a front view of the essential part of a conventional anchor bolt fixing device. In the figure, numeral 1 refers to an anchor frame formed in a square frame using equal angles in which an upper anchor plate 2 and a lower anchor plate 3 are fixedly fitted to the upper part thereof and at a location slightly higher than the lowermost part thereof, respectively, so that anchor bolts are held in position by retaining holes (not shown) provided on the upper and lower anchor plates 2 and 3. The vertical positioning of the anchor bolts 4 is effected by interposing the lower anchor plate 3 between nuts 6 via a square washer plate 5. With this arrangement, an anchor frame 1 is placed at a predetermined location on a precast concrete subslab 7 and secured in position by driving drill anchors 9, etc. to form a concrete foundation 8 as shown by a chain line in the figure.

The anchor frame 1 constituting the above-mentioned conventional anchor-bolt fixing device, which is normally fabricated and assembled in advance at factory and transported to the erection site, has the following problems.

(1) The anchor frame 1, which has a large number of protruded parts, tends to be deformed during transportation due to stacking and collision of multiple anchor frames 1. This could result in the difficulty in embedding the anchor bolts 4 in the concrete foundation 8 with high accuracy.

(2) Since the anchor frame 1 is usually fabricated and assembled by welding, it is difficult to adjust the positions of the anchor bolts 4 in the horizontal or vertical direction on the erection site.

(3) Since the washer plate 5 to which the bottom end of the anchor bolt 4 has a large horizontal projected area, the anchor frame 1 must be made sufficiently large to accommodate the washer plate 5.

(4) The anchor frame 1 must have a sufficiently high rigidity to prevent the anchor bolts 4 from moving during placement of the concrete foundation 8. For this reason, anchor frame members must be of a relatively large size. This could lead to increased possible interference of anchor frame members with reinforcing bars (not shown) used in the concrete foundation 8.

(5) The outside surface of the anchor bolt 4 is covered by a non-stick covering sleeve (not shown in FIG. 1). As shown in FIG. 2, the top end of the anchor bolt 4 is supported by the upper anchor plate 2 of the anchor frame 1 via the covering sleeve 11. The anchor bolt 4, however, tends to be secured in a tilted fashion, as shown in FIG. 3, due to a gap among the upper anchor plate 2, the sleeve 11 and the anchor bolt 4. It is impossible, therefore, to improve the anchoring accuracy of the anchor bolts 4.

A normal practice for erecting a steel-frame column on the concrete foundation 8 is such that a column base metal fitting is integrally joined to the column base portion of the steel-frame column, and the column base metal fitting is tightly secured to the concrete foundation 8 by the anchor bolts 4. An example of the column base metal fitting is the structure of a shape shown in FIG. 4. The column base metal fitting 10 has a square base plate 12 and a square raised portion 13. On the base plate 12 provided are thick portions 14 at the four corners thereof, having anchor-bolt holes 15 drilled at each corner thereof. The raised portion 13 is of a square, rectangular, circular, H- or any other shape corresponding to the cross-sectional shape of the steel-frame column to be joined.

The column base metal fitting 10 is made usually by casting or forging, with the anchor bolt holes 15 thereof being formed after casting or forging. When forming the anchor bolt holes 15, two orthogonally intersecting center lines **16*a* and 16*b* passing through the center A of the base plate 12 are marked, and then center lines 17*a* and 17*b* of the holes 15 are marked based on these center lines 16*a* and 16*b* to accurately determine the positions of the holes 15. The holes 15** are drilled on the centers B thus obtained.

When joining a steel-frame column to the raised portion 13, a center line **19*a*, as shown in FIG. 6, marked on the side surface of the raised portion 13 is matched with a center line 19*b* showing the center of the steel-frame column 18 to weld the steel-frame column 18 to the raised portion 13. The column base thus formed by welding the column base metal fitting 10 to the steel-frame column 18 is secured to the concrete foundation 8 by the anchor bolts 4 and the nuts 6, as shown in FIG. 6**.

This marking operation, however, has to be performed on each piece of the column base 10, requiring much labor and time. In other words, the conventional erection work using the column base metal fitting 10 involves high erection costs.

In the above-mentioned column base structure, where the column base metal fitting 10 has to be brought in close contact with the concrete foundation 8, mortar must be cast into the gap between both. FIG. 7 is a longitudinal section of the essential part corresponding to a column base structure shown in FIG. 6. In the figure, the column base metal fitting 10 is integrally joined by welding to the steel-frame column 18 made of a steel material, and the assembly thus formed is placed on the concrete foundation 8 via a precast central mortar 20. In this case, since a predetermined number of anchor bolts 4 are embedded in the concrete foundation 8, positioning is performed by bolt holes (not shown) provided on the column base metal fitting 10. After that, mortar 21 is cast into the gap between the column base metal fitting 10 and the concrete foundation 8. After the mortar 21 has been hardened completely, the nuts 6 are fastened to the anchor bolts 4 via washers 22 to secure the steel-frame column 18 in place. Numeral 23 refers to a form for defining the outside dimensions when casting mortar 21.

With the above-mentioned conventional column base structure, when the mortar 21 is cast in the gap between the column base metal fitting 10 and the concrete foundation 8 after the column base metal fitting 10 has been placed on the central mortar 20, a cavity 24 is often produced due to the air entrapped by the mortar resulting in poor contact of the mortar 21 with the entire bottom surface of the column base metal fitting 10.

FIG. 8 is a diagram illustrating the flow of mortar in the form 23. In FIG. 8, shown by a chain line is the outside contour of the column base metal fitting 10. The central mortar 20 is most commonly formed in a quadrilateral form, as shown in the figure. When the mortar 21 is case in the state shown in FIG. 8 from the direction shown by arrow C by means of a hopper or any other container, the mortar 21 flows along the flow lines shown by arrow D, but the flow of mortar is parted at the central mortar 20 and then joined together again on the downstream side of the central mortar 20. At this time, the flow of mortar entraps the air present between the column base metal fitting 10 and concrete foundation 8, forming a cavity 24 as shown by a shaded part.

The critical performance requirements for the column base structure include the adhesion between the mortar 20 and the column base metal fitting 10, as well as the rigidity of the column base metal fitting 10 and the fastening strength of the anchor bolts 4. In the presence of a cavity 24 on the bottom surface of the column base metal fitting 10, however, satisfactory performance for the column base structure cannot be maintained, deteriorating remarkably the earthquake resistance of the structure.

The column base metal fitting 10 and the concrete foundation 8 are joined together by the fastening strength of the anchor bolts 4 and the nuts 6. If a bending moment is exerted on the column base, the column base metal fitting 10 is deformed locally and in a complicated manner. The tension value to be added to the anchor bolt 4 has not been clearly specified as an industry standard value, and set for individual buildings. In addition, the evaluation method of performance (anchoring degree) has not been formally specified in the trade.

That is, the conventional column base structure has not necessarily accomplished a high anchoring degree by fully utilizing the performance of the anchor bolts 4 for the above reasons, and it is difficult to accurately grasp the anchoring degree at the time of the design of a building. All this leaves a great uncertainty about the safety of buildings.

Next, the external forces exerting on the column base structure will be discussed. FIG. 9 is a diagram of assistance in explaining the external forces exerting on the column base structure. Like parts are indicated by like numerals in FIG. 6. In FIG. 9, an axial force N and a horizontal force F, both resulting from the weight of the building, earthquake and storm, are applied onto the steel-frame column 18. The horizontal force F produces a bending moment M to bend the column base, and a shearing force Q to move the column base horizontally. To cope with the bending moment M and the axial force N, the column base structure is designed in such a manner that the stresses are transmitted from the steel-frame column 18 to the column base metal fitting 10, the anchor bolts 4, and the concrete foundation 8. When the shearing force Q is small, the column base structure is designed in such a manner that the stresses are transmitted from the steel-frame column 18 to the column base metal fitting 10, and the concrete foundation 8. In this case, the transmission of stresses from the column base metal fitting 10 to the concrete foundation 8 is effected by a frictional resistance $Qa_1$ between the column base metal fitting 10 and the concrete foundation 8 caused by the axial force N exerting on the column base structure and the tensile force of the anchor bolts 4. When the shearing force Q is too large to be offset by the frictional resistance $Qa_1$ between the column base metal fitting 10 and the concrete foundation 8, the column base structure is designed in such a manner that the stresses are transmitted from the steel-frame column 18 to the column base metal fitting, the flat washer 22, the anchor bolts 4, and the concrete foundation 8. To this end, the inside diameter of the flat washer 22 is made relatively smaller so as to reduce the clearance between the inside diameter of the flat washer 22 and the outside diameter of the anchor bolts 4, and the entire outer periphery of the flat washer 22 is fillet-welded to the column base metal fitting 10, as shown in FIG. 10. Numeral 25 in the figure indicates a welded zone.

More recently, there is a growing demand for improving the strength performance of the column base structure from considerations of aseismic design. In order to realize this, selection of good quality anchor bolts 4 having excellent mechanical properties (in terms of yield point and tensile strength) is of critical importance.

When anchor bolts 4 having a tensile strength of over 50 $kg/mm^2$ are used for the column base structure, however, flat washers 22, which are generally made of the same quality as the anchor bolts as set fasteners, cannot be welded to the column base metal fitting 10 because of the high carbon content and carbon equivalent ($C_{eq}$) thereof. For this reason, when anchor bolts 4 of this degree of strength (with a tensile strength of over 50 $kg/mm^2$) are used, large shearing force Q cannot be transmitted to the column base metal fitting 10. The use of anchor bolts 4 of this degree of strength could therefore help improve the flexural strength Ma (resistance to bending moment M) of the column base structure, but the shearing strength Qa thereof could be lowered because the shearing strength Qa can be maintained only by the frictional resistance $Qa_1$.

SUMMARY AND OBJECTS OF THE INVENTION

It is the first object of this invention to provide a column base structure having a high anchor bolt fixing accuracy.

It is the second object of this invention to provide a column base structure in which the positioning and embedding of anchor bolts are made extremely easy.

It is the third object of this invention to provide a column base structure in which the positioning and embedding of anchor bolts are made extremely easy.

It is the fourth object of this invention to provide a column base structure in which the adhesion of the column base metal fitting and the concrete foundation is large, and the earthquake-proofing performance is remarkably improved.

It is the fifth object of this invention to provide a column base structure in which a predetermined initial tensile strength is introduced to anchor bolts to improve safety performance.

According to the invention, a column base structure is formed and the connection between the column base structure and a steel frame column is also formed. The steel frame column is integrally joined to a column base metal fitting. The column base structure includes support members fixedly fitted to a concrete subslab. Horizontal support members of fixedly fitted to upper ends of the support members which project upwardly from the support subslab. An anchor bolt frame is provided, assembled by fixedly fitting upper and lower anchor plates to upper and lower ends of anchor bolts, the anchor bolts having threaded parts at the upper and lower ends thereof. This anchor bolt frame is then fixedly fitted to the horizontal support members. A concrete foundation is poured around the anchor bolt frame, the horizontal support members and the support members to form the column base structure. The concrete extends to a level of the anchor bolt frame such that the upper anchor plate is positioned outside of the concrete foundation. The upper anchor plate maintains the anchor bolts in proper position during the pouring of the concrete and the upper anchor plate is removed after the concrete is poured. The column base metal fitting includes a raised portion formed into a planar shape corresponding to the contour of an end face of the steel frame column and a base plate formed into a flat plate. The column base metal fitting and the concrete foundation are joined together via the anchor bolts and nuts after the anchor plate has been removed. The anchor bolts and nuts secure a central mortar which is provided in advance of the steel frame, on the concrete foundation. A mortar cast is provided after the column base metal fitting is connected to the anchor bolts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 11A:
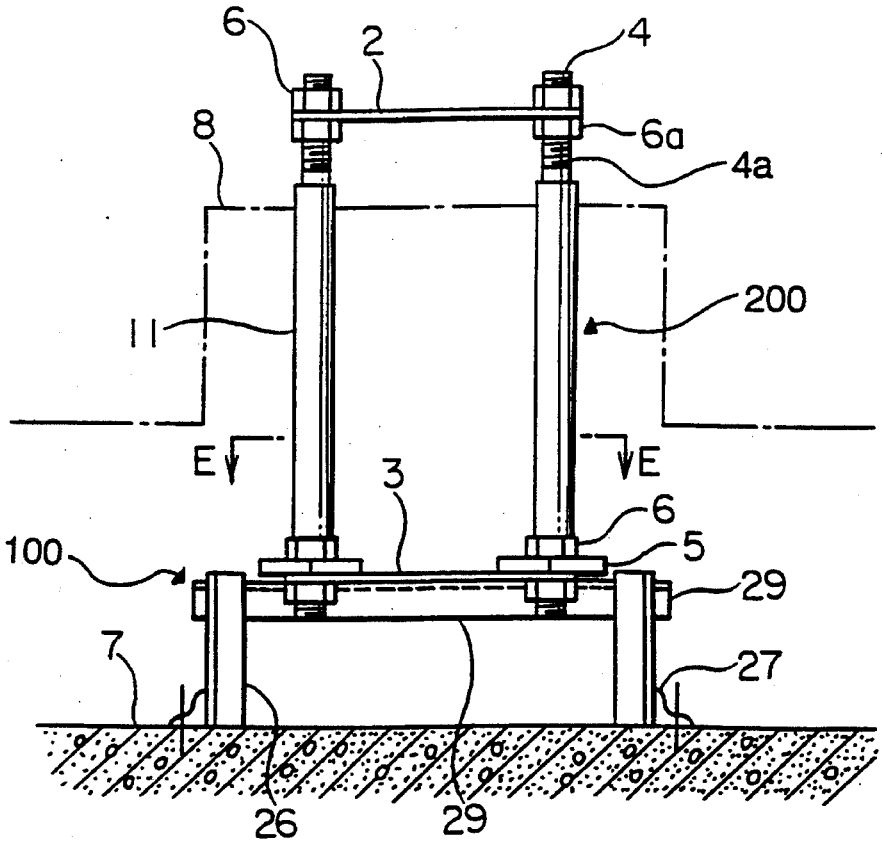
FIG. 11*a* is a front view illustrating the state where anchor bolts are held in position according to a first embodiment of this invention.
Figure 12:
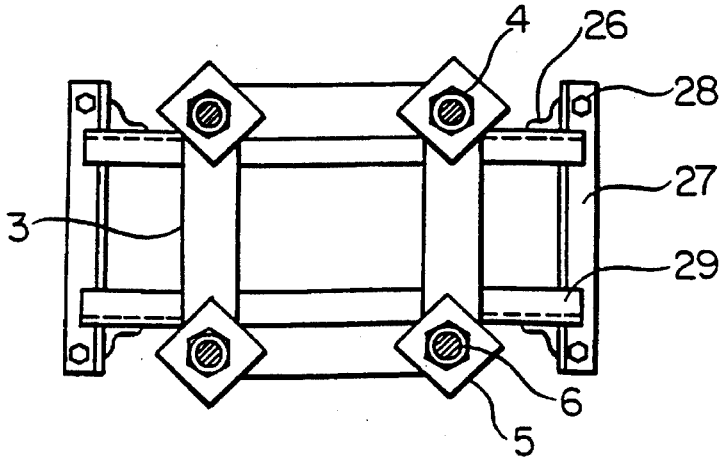
FIG. 12 is a cross-section taken along line E—E in FIG. 11*a*.
Figure 11B:
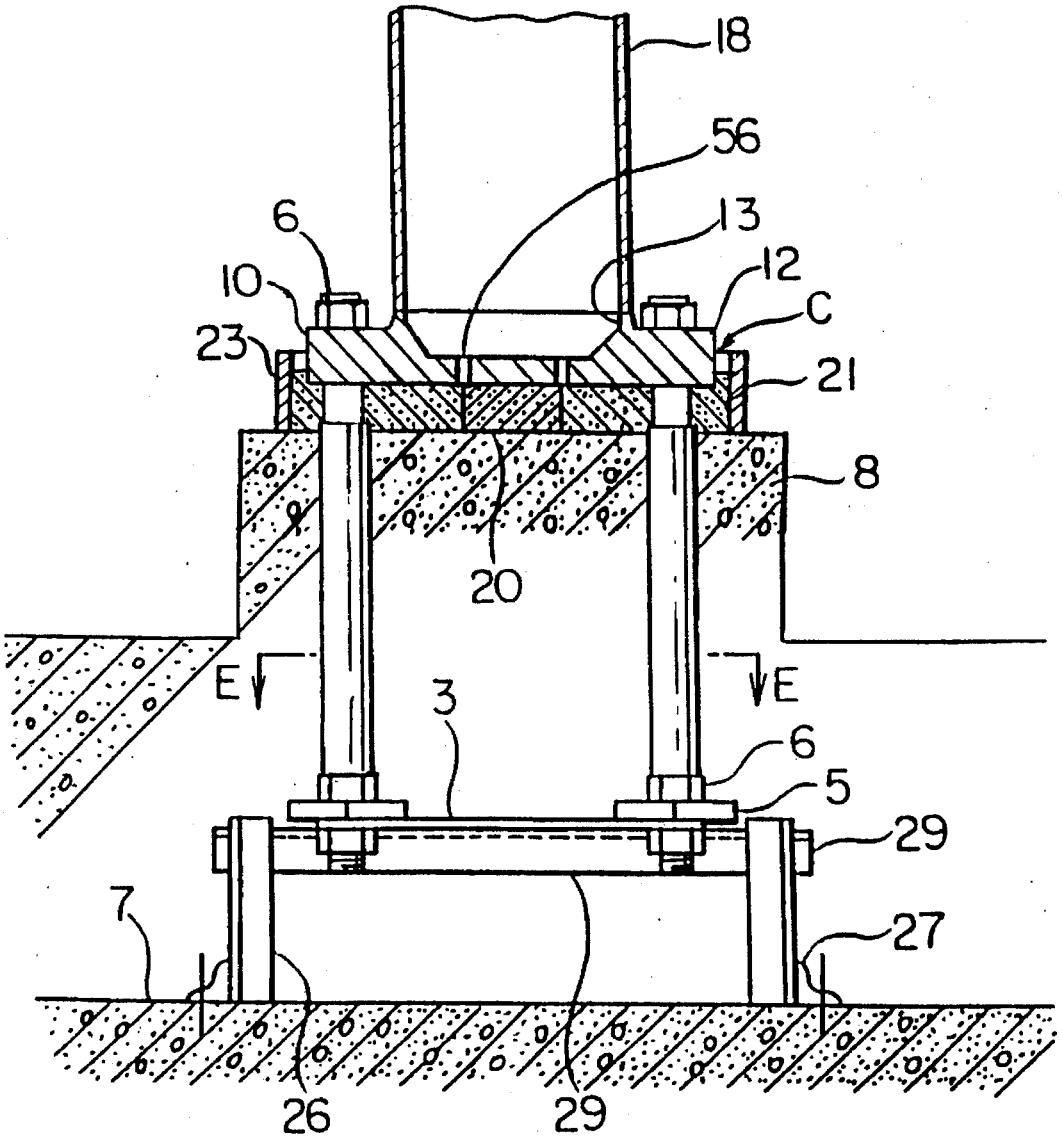
FIG. 11*b* is a front view showing the state in which the upper anchor plate has been removed and the anchor bolts connect to the column base metal fitting of the steel frame column.

Referring to the drawings and in particular to the embodiment of FIGS. 11*a*, 11*b* and 12, the invention comprises a support arrangement generally designated 100 which includes plural support members 26 which are fixedly fitted to a concrete subslab 7. The support members 26 may be fixedly fitted to the concrete slabs in several ways according to the invention and according to the embodiment of FIGS. 11*a*, 11*b* and 12, the vertical support members 26 are fixedly fitted by welding the support members 26 to a plurality of fixing members 27. These fixing members are then positioned in a predetermined location on the concrete subslab 7 by means of fixing bolts 28 (see FIG. 12). A plurality of horizonal support members 29 are provided, preferably formed of steel and are welded to the support members 26 at a predetermined height in such a manner that the top surface of the horizontal support member 29 forms a substantially horizontal plane.

Figure 15:
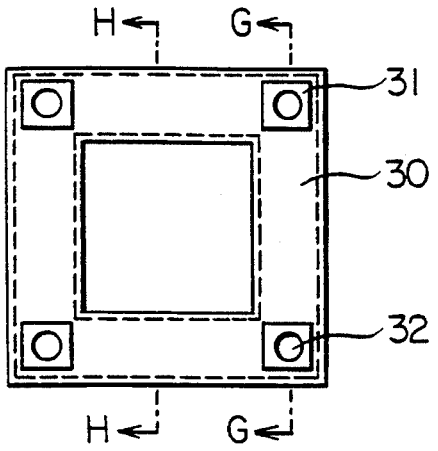
FIG. 15 is a plan view illustrating an anchor plate according to a third embodiment of this invention.

An anchor bolt assembly 200 is then formed comprising an upper anchor plate 2 and a lower anchor plate 3. The anchor plates 2 and 3 each have holes drilled in the plate at predetermined intervals such as at the corner points of a square anchor plate structure as shown in FIG. 15. Other forms of the anchor plate structure are shown and described with reference to FIGS. 15 through 25 below.

The anchor plates are connected as shown in FIG. 11 by an arrangement including washer plates 5, formed with a square shape as shown in FIG. 12 provided on the upper part of the lower anchor plate 3. The lower anchor plate 3 is secured by anchor bolts 4 and by lower nuts 6, one nut provided above the washer plate 5 and one provided below the lower anchor plate 3 as shown in FIGS. 11*a* and 11*b*. The rigidity of the anchor bolts may be selected as discussed below with reference to FIGS. 43–51. The upper anchor plate 2 is secured to the anchor plate 3 by means of the anchor bolts 4 and the upper and lower nuts 6*a*. Covering sleeves 11 are preferably provided over the shanks of the anchor bolts 4 positioned between the upper nut 6, adjacent the lower anchor plate 3 and the lower nut 6*a* associated with the upper anchor plate 2. This assembly including four anchor bolts 4 and two anchor plates including upper anchor plate 2 and lower anchor plate 3 provides a rigid anchor bolt assembly 200 in which the upper anchor plate and the lower anchor plate are positioned parallel to each other and maintain the four anchor bolts 4 spaced evenly from each other in a predetermined manner.

The anchor plate assembly 4 is then placed on the horizontal support members 29 and the anchor bolts are welded to the horizontal support members 29. The concrete foundation 8 may then be poured to a point below the anchor plate 2 (preferably to a point spaced a distance below threads 4*a*) and the anchor plate/bolt assembly 200 is positioned with a high degree of accuracy with respect to the subsequent poured concrete due to the rigid anchor plate anchor bolt assembly 200 and due to a connection of this rigid assembly to the support assembly 100.

After the concrete foundation 8 has been put in place (after the poured concrete foundation 8 has cured or prior to this time depending upon the nature of the concrete used), the upper and lower bolts 6 are removed along with the upper anchor plate 2. The protruding anchor bolts 4 are still maintained in the predetermined position with a high degree of accuracy even after the pouring of the concrete and the arrangement including the four extending anchor bolts 4 is positioned for engagement with a formed steel frame column.

FIG. 11*b* shows the connection between the anchor bolts 4 positioned within the concrete foundation 8 and the steel frame column 18. This partially cross-sectional plan view shows the steel frame column 18 provided with a column base metal fitting 10. This base metal fitting is formed of cast steel and has a raised portion 13 having a plane corresponding to the profile of the end face of the foot of the steel frame column 18, which is integrally formed with a plate base plate 12. The base plate connection arrangement is generally designated 300. The bolt holes 301 are positioned at predetermined locations corresponding to the predetermined position of the anchor bolt 4, set by the upper anchor plate 2. The projected plane shape of the raised portion 13 and the base plate 12 is almost a square corresponding to the cross-sectional shape of the steel frame column 18.

Figure 40:
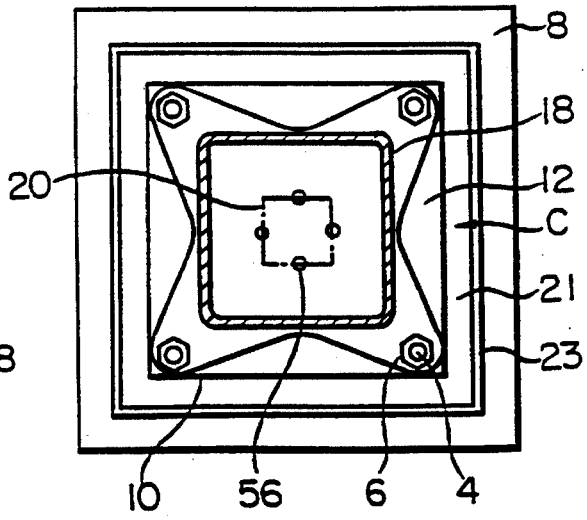

The base plate 12 also includes holes 56 which are provided at locations almost corresponding to the contour or outer periphery of a central mortar 20 (FIG. 40). The holes are preferably provided by piercing through the column base metal fitting 10.

Figure 37:
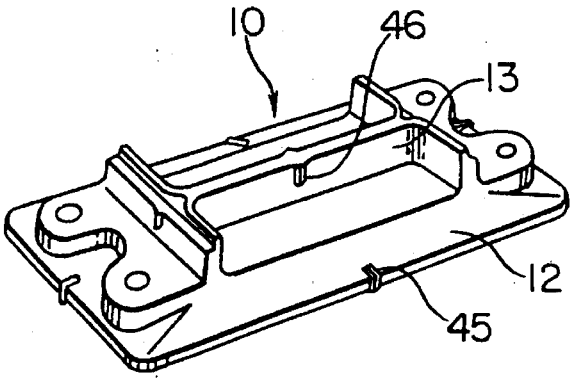
FIGS. 37 and 38 are perspective view illustrating column base metal fittings used in fourteenth and fifteenth embodiments of this invention.
Figure 38:
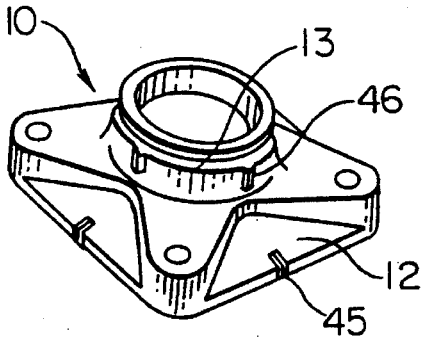
Figure 39:
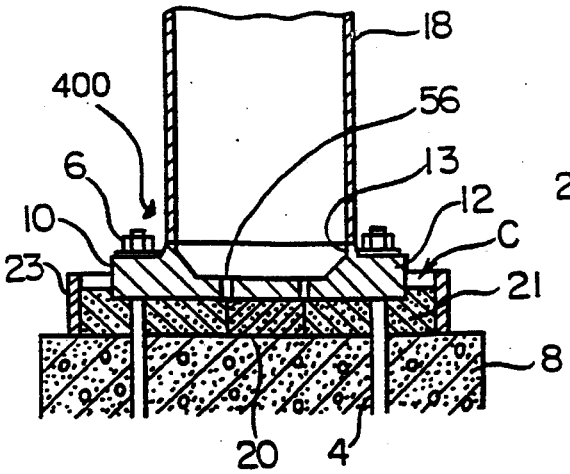
FIGS. 39 and 40 are a longitudinal section and a partially cross-sectional plan view of the essential part of a sixteenth embodiment of this invention.

The invention preferably provides that the column 18 and the column base metal fitting 10 are joined together by welding to form the integral steel frame column/column base metal fitting structure 400, as shown in FIGS. 11*b* and 39 (see also the embodiment of FIGS. 35 through 38 and 41).

Figure 1:
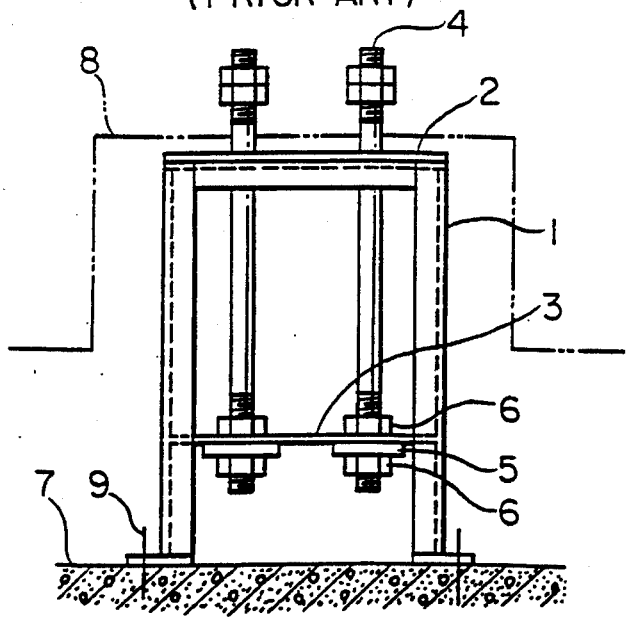
FIG. 1 (PRIOR ART)
FIG. 1 is a front view of the essential part of a conventional anchor bolt fixing device.
Figure 2:
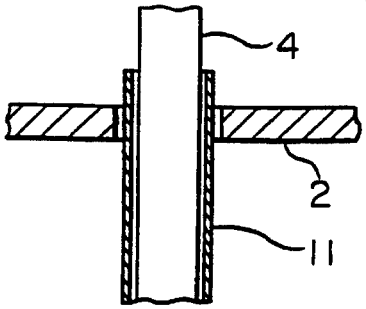
FIG. 2 (PRIOR ART)
FIGS. 2 and 3 are partially enlarged longitudinal sections illustrating the relationship between an anchor bolt and an upper anchor plate of the anchor bolt fixing device at the upper part of the anchor bolt.
Figure 3:
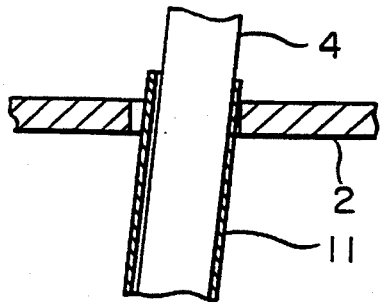
FIG. 3 (PRIOR ART)
Figure 4:
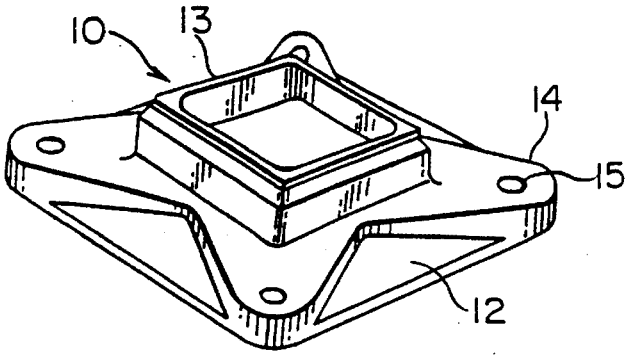
FIG. 4 (PRIOR ART)
FIG. 4 is a perspective view illustrating a conventional column base metal fitting.
Figure 5:
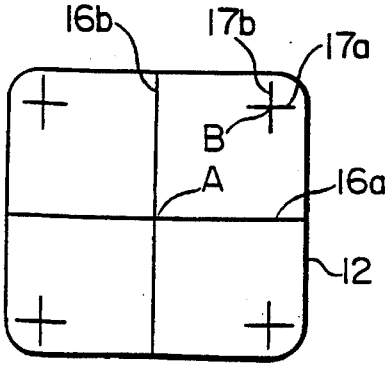
FIG. 5 (PRIOR ART)
FIG. 5 is a diagram illustrating center lines marked on the bottom surface of the column base metal fitting shown in FIG. 4.
Figure 6:
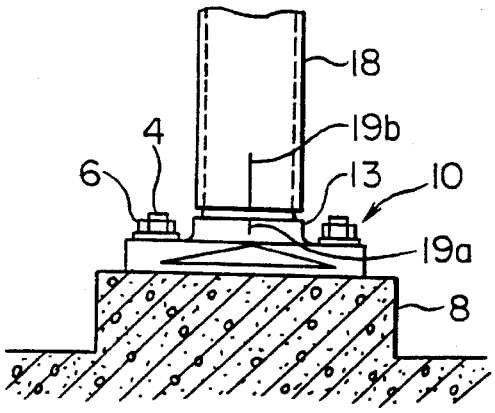
FIG. 6 (PRIOR ART)
FIG. 6 is a front view illustrating the state where the steel-frame column is anchored to a concrete foundation using the column base metal fitting shown in FIG. 4.
Figure 7:
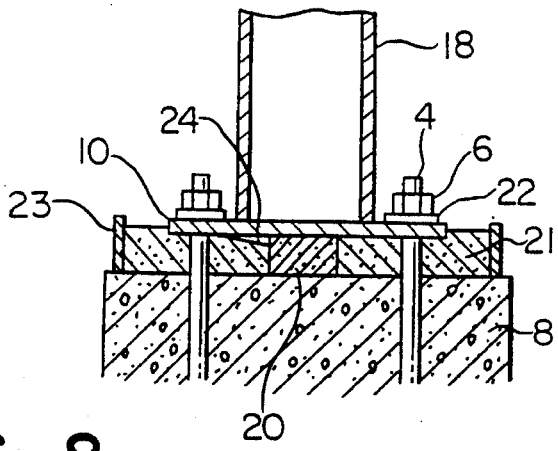
FIG. 7 (PRIOR ART)
FIG. 7 is a longitudinal section of the essential part corresponding to the column base structure shown in FIG. 6.
Figure 8:
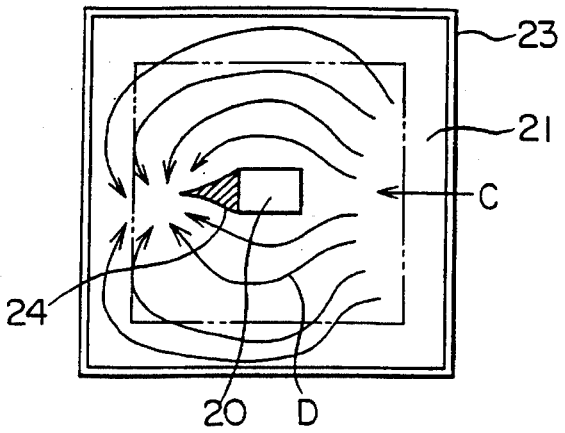
FIG. 8 (PRIOR ART)
FIG. 8 is a diagram of assistance in explaining the flow of mortar in a form.
Figure 9:
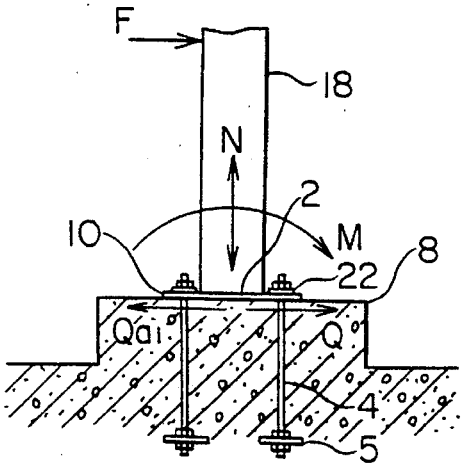
FIG. 9 (PRIOR ART)
FIG. 9 is a diagram of assistance in explaining the external force exerted on a column base structure.
Figure 10:
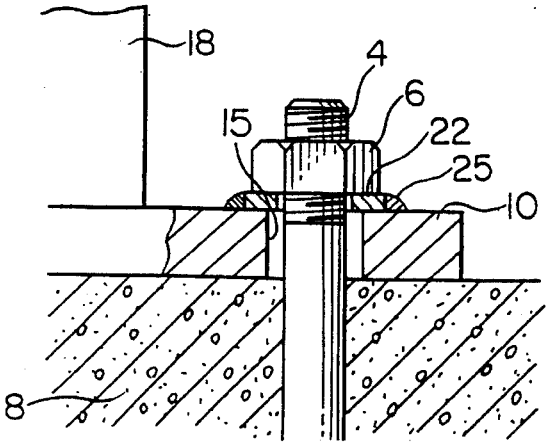
FIG. 10 (PRIOR ART)
FIG. 10 a partially enlarged longitudinal section of the essential part illustrating the state where a flat washer is welded to a conventional column base metal fitting.

A central mortar 20 is provided having a shape preferably based on the holes 56 discussed above. The central mortar 20 is provided in advance on the concrete foundation 8 and subsequently the steel frame column/column base metal fitting construction 400 is positioned on the central mortar 20. The column base metal fitting 10 of the construction 400 may be connected to the anchor bolts 4 using the upper nuts 6*a*. Additional mortar 21 may then be cast into a form 23, preferably in the direction shown by arrow C in FIG. 40. By this arrangement and system, even if air is entrapped, the air can be easily discharged through holes 56 provided on a column base metal fitting 10. Consequently, the additional mortar 21 can be cast without hinderance, insuring perfect adhesion of the mortar 21 to the bottom surface of the base metal fitting 10. Accordingly, cavities 24 as shown in the prior art arrangement discussed with regard to FIG. 7 and 8 are eliminated according to the present invention.

Figure 13A:
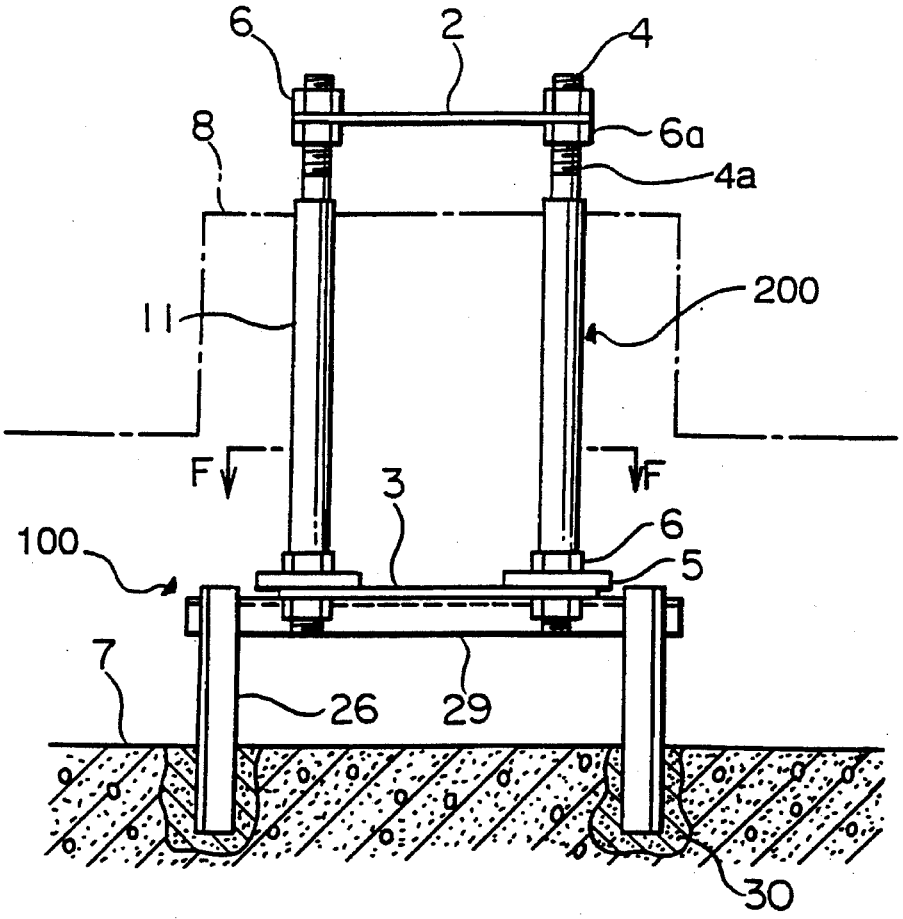
FIG. 13*a* is a front view illustrating the state where anchor bolts are held in position in a second embodiment of this invention.
Figure 14:
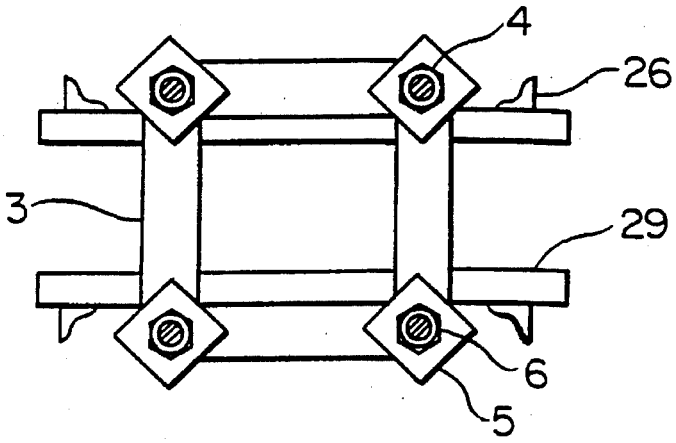
FIG. 14 is a cross-section taken along line F—F in FIG. 13*a*.
Figure 13B:
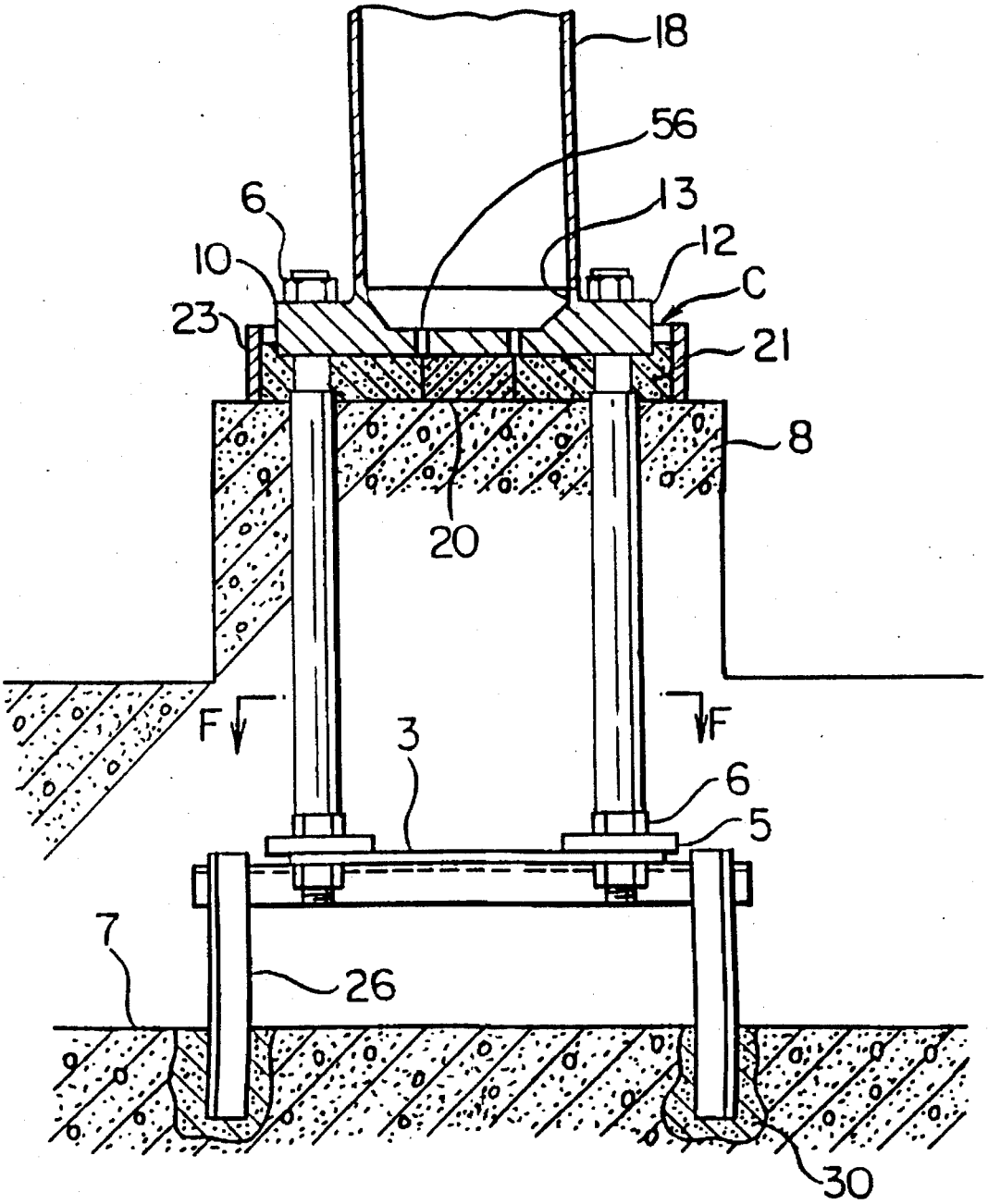
FIG. 13*b* is a front view of the embodiment of FIG. 13*a* showing the state where the upper anchor plate has been removed and the anchor bolts are connected to the column base metal fitting of the steel frame column.

The invention also contemplates various modifications of the basic structure of the invention as discussed above. For example, the embodiment of FIGS. 13*a*, 13*b* and 14 provide an arrangement in which the support members 26 are connected to the concrete slab in a different manner from the embodiment of FIGS. 11*a*, 11*b* and 12. FIGS. 15 through 28 illustrate various forms of anchor plates which may be employed according to the invention.

Figure 30:
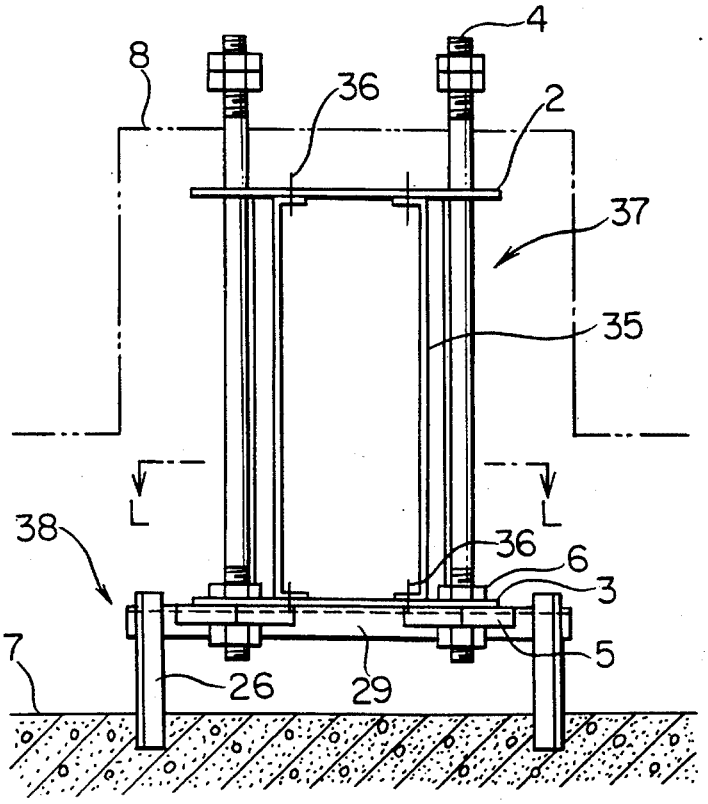
FIG. 30 is a front view of the essential part of an anchor bolt retainer according to an eleventh embodiment of this invention.
Figure 31:
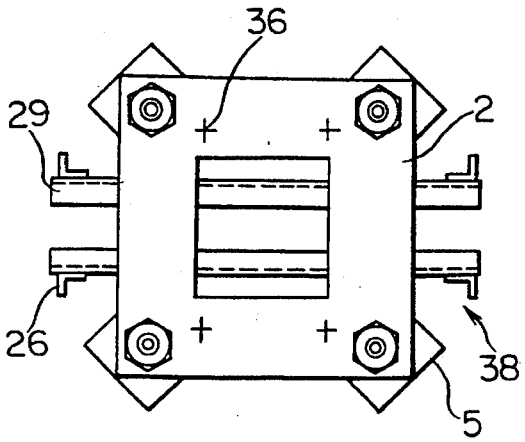
FIG. 31 is a plan view of the anchor bolt retainer shown in FIG 30.
Figure 32:
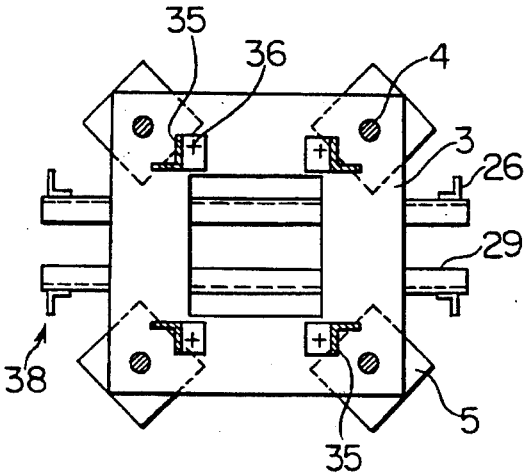
FIG. 32 is a cross-section taken along line L—L in FIG. 30.
Figure 33:
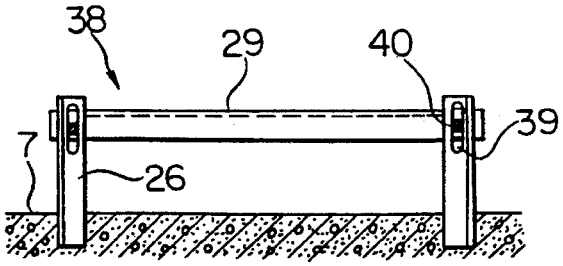
FIGS. 33 and 34 are a front view and a plan view of the essential part of a support arrangement used in a twelfth embodiment of this invention.
Figure 34:
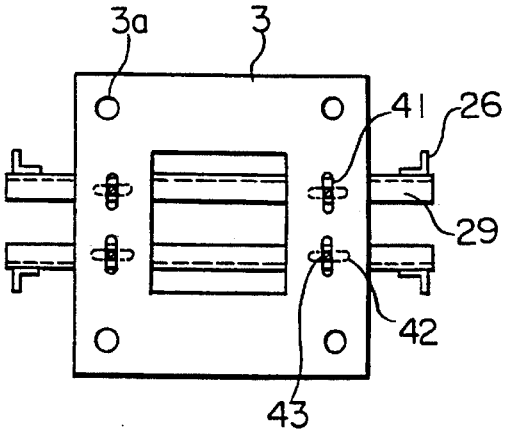

The embodiment of FIGS. 30 through 32 shows an alternative construction of the anchor plate arrangement 200 in which additional angle member 35 are employed. FIGS. 33 and 34 show a variation of the support arrangement 100. FIGS. 35 through 38 shows a technique and further arrangement according to the invention in which the base metal fitting 10 is machined and aligned for aligning with a bolt hole 15 and positioning the base column fitting 10 on the foundation 8.

Figure 41:
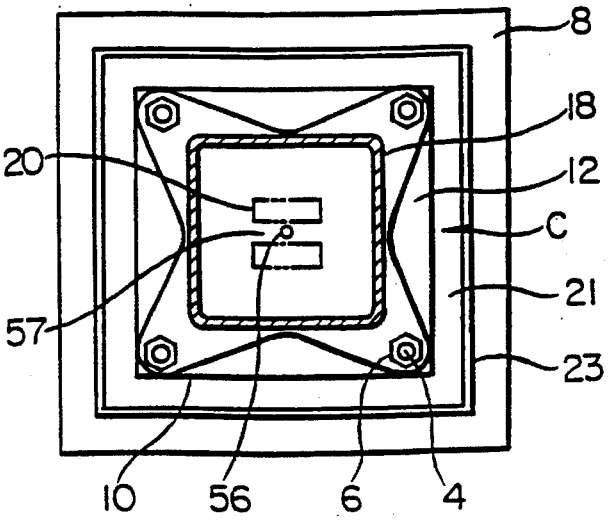
FIG. 41 is a partially cross-sectional plan view illustrating a seventeenth embodiment of this invention.
Figure 42:
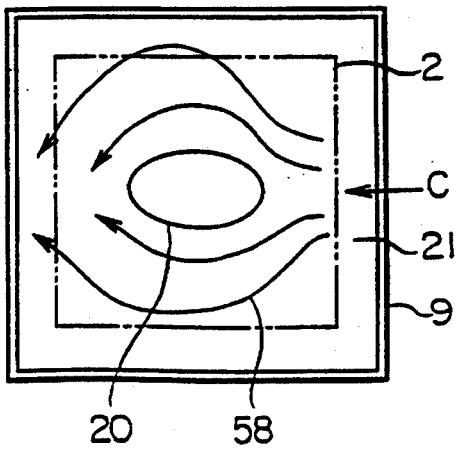
FIG. 42 is a plan view illustrating the flow of mortar in an eighteenth embodiment of this invention.

The embodiments of FIGS. 39 and 40 show the preferred positioning of the holes 56 according to the first embodiment of the invention and the embodiment of FIGS. 41 and 42 show an alternative positioning of a hole 56.

By adopting the above-mentioned construction, the following effects can be obtained.

(1) Since only component members can be cut to predetermined lengths and fabricated in advance at factory and then brought into the erection site for assembly, transport operations can be made quite easy.

(2) Since the column base structure of this invention has few protrusions, unlike the conventional anchor frame, and is hardly subjected to deformation during transportation for the reason mentioned in (1) above, the accuracy of the anchor bolt retainer and the anchor bolts 4 can be improved substantially.

(3) Since the anchor bolt supporting assembly consists of relatively few elements such as the anchor bolts 4, the upper anchor plate 2 and the lower anchor plate 3, the interference of the anchor frame with reinforcing bars in the concrete foundation 8 can be substantially reduced.

(4) As the lower anchor plate 3 is provided under the washer plate 5, the horizontal support members 29 provided directly under the lower anchor plate 3 do not interfere with the washer plate 5. As a result, both the washer plate 5 and the lower anchor plate 3 can be disposed at a location closer to the nuts fastened to the lower threaded parts of the anchor bolts 4, with the result that the intervals of the horizontal support members 29 can be increased. This could contribute much to reducing the deformation of the lower anchor plate 3 caused by the deposition of the concrete foundation 8, and therefore preventing the anchor bolts 4 from center misalignment.

(5) Since the upper anchor plate 2 is connected to the anchor bolts 4 without the use of the covering sleeve 11, the positioning accuracy of the anchor bolts 4 is not affected by the gap between the covering sleeve 11 and the anchor bolts 4.

Thus, with the anchor bolt fixing device having the above-mentioned construction, the anchor bolts 4 can be embedded into the concrete foundation 8 in an accurately positioned state.

ALTERNATIVE FIXATION ARRANGEMENT FOR SUPPORT ASSEMBLY

FIG. 13 is a front view illustrating the state where anchor bolts are supported using a modified support assembly according to the invention. FIG. 14 is a cross-section taken along line F—F in FIG. 13. The arrangement of the anchor bolts 4 and others is the same as in the embodiment shown in FIGS. 11 and 12, except that Four support members 26 made of angles, for example, are embedded into the concrete subslab 7 by casting mortar 30', and the horizontal support members 29 are fixedly fitted to the support members 26 in such a manner that the top surface of the horizontal support members 29 forms a substantially horizontal plane. Other arrangements are the same as in the case of the first embodiment. In both the above-mentioned embodiments, the upper anchor plate 2 is not embedded into the concrete foundation, and the upper nuts 6*a* are removed before the steel-frame column connected to the anchor bolts 4 is erected.

A column base metal fitting connected to the steel frame column as shown in FIG. 39 is then placed on the concrete foundation 8, and the nuts 6 are fastened onto the anchor bolts 4 to complete the column base structure (see FIG. 39).

ALTERNATIVE CONSTRUCTION OF ANCHOR PLATE

Figure 16:
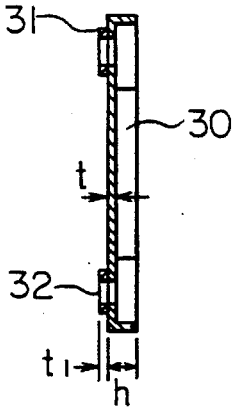
FIGS. 16 and 17 are cross-sections taken along lines G—G and H—H of FIG. 15, respectively.
Figure 17:
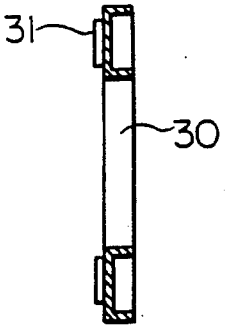

FIG. 15 is a plan view illustrating an anchor plate in a third embodiment of this invention. FIGS. 16 and 17 are sections taken along lines G—G and H—H in FIG. 15. In the fixtures, an anchor plate 30 corresponds to the upper and lower anchor plates 2 and 3 in the above-mentioned embodiments, and is formed into a hollow quadrilateral using steel plates having a thickness of t, with the cross-section of each side formed into an approximately U-shape and the height h made larger than t. At each corner of the anchor plate 30 fixedly fitted by welding are washers 31 made of steel plates having a thickness of $t_1$, and drilled are anchor bolt holes 32 for inserting anchor bolts (not shown).

With the above arrangement, the rigidity of the anchor plate 30 can be adequately maintained since the height h of the cross-section of each side of the anchor plate 30 is made larger than the thickness t of the steel plate. By fixedly fitting the washers 31 at each corner, the anchor bolts (not shown) can be passed through the anchor bolt holes 32 with ease, and the positioning accuracy of the anchor bolts can be substantially improved.

Figure 18:
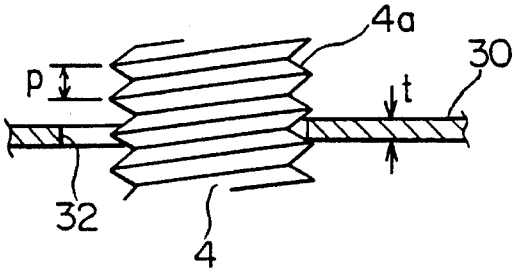
FIG. 18 is a partially enlarged cross-section illustrating the sate where an anchor bolt is inserted into an anchor plate.

FIG. 18 is an enlarged cross-section of the essential part illustrating the state where the anchor bolts are inserted into the anchor plate. In the figure, if the thickness t of the anchor plate 30 is smaller than the pitch p of the thread 4*a* provided on the anchor bolt 4, the anchor plate 30 cuts into the root of the thread 4*a*, making it difficult to insert the anchor bolt 4 into the anchor bolt hole 32. This also causes the anchor bolt 4 to be tilted, lowering the positioning accuracy of the bolt 4. This inconvenience can be eliminated by providing the washer 31 on the anchor plate 30, as shown in FIGS. 15 through 17. In this case, the relationship among the thickness t of the anchor plate 30 and the thickness t1 of the washer 31 and the pitch p of the thread 4*a* should preferably be such that $(t+t_1)>p$, where t may be equal to $t_1$.

Figure 19:
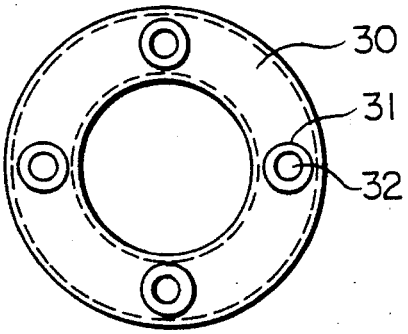
FIGS. 19 and 20 are plan view illustrating anchor plate used in fourth and fifth embodiments of the invention.
Figure 20:
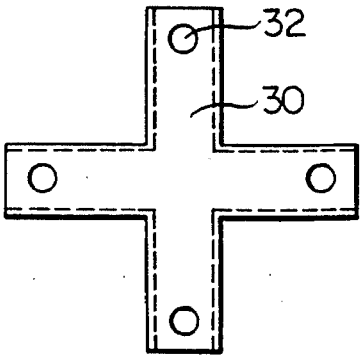

FIGS. 19 and 20 are plan view illustrating anchor plates used in a fourth and fifth embodiments of this invention. Like parts are indicated by like numerals used for explaining the third embodiment. In the fourth embodiment shown in FIG. 19, the anchor plate 30 is formed into a hollow annular shape, with the washers 31 formed into a hollow circular disc shape disposed at equal intervals. The cross-section of the anchor plate 30 is formed into an approximately U shape, as in the third embodiment. In the fifth embodiment shown in FIG. 20, the anchor plate 30 is formed into a cross shape, with the anchor bolt holes 32 drilled in the vicinity of the ends of the cross-shaped anchor plate 30. In this embodiment, the washers as used in the above embodiments are omitted because the washers may be omitted, depending on the diameter, thread pitch of anchor bolts (not shown).

Figure 21:
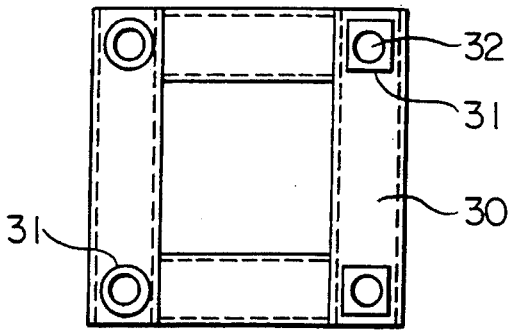
FIGS. 21 and 22 are plan views illustrating anchor plates used in sixth and seventh embodiments of this invention.
Figure 22:
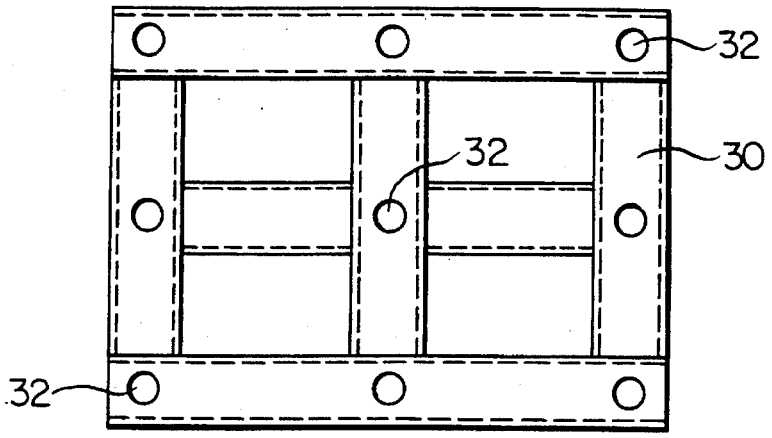

FIGS. 21 and 22 are plan view illustrating anchor plates used in sixth and seventh embodiments of this invention. Like parts are indicated by like numerals in the above embodiments. The anchor plate 30 in both figures can be formed integrally by welding channels, for example. When the anchor plate is of too large a size to be fabricated from a single steel plate, it is effective to fabricate the anchor plate from a plurality of members.

Figures 23, 24, 25:
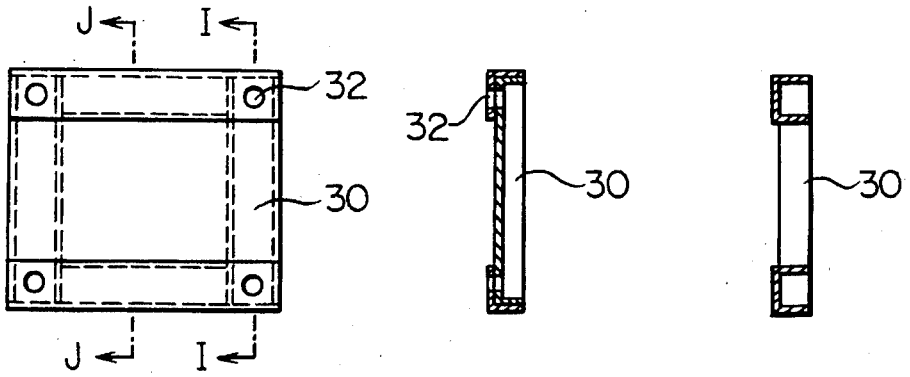
FIG. 23 is a plan view illustrating an anchor plate used in an eighth embodiment of this invention.
FIGS. 24 and 25 are cross-sectional of views taken along lines I—I and J—J in FIG. 23.

FIG. 23 is a plan view illustrating an anchor plate used in an eighth embodiment of this invention, and FIGS. 24 and 25 are cross-sections taken along lines I—I and J—J, respectively, in FIG. 23. The eighth embodiment shown in these figures is the same as the sixth and seventh embodiments in that the anchor plate 30 is integrally formed by welding channels, for example. In this embodiment, however, component members are overlapped at the corners. This construction makes it easy and simple to assemble the anchor plate 30 by welding. In addition, this construction can prevent anchor bolts from cutting into the anchor plate, as described earlier, and eliminate washers for preventing anchor bolts form cutting into the anchor plate because the thickness of the anchor plate 30 around the anchor bolt holes 32 can be made larger.

Figure 26:
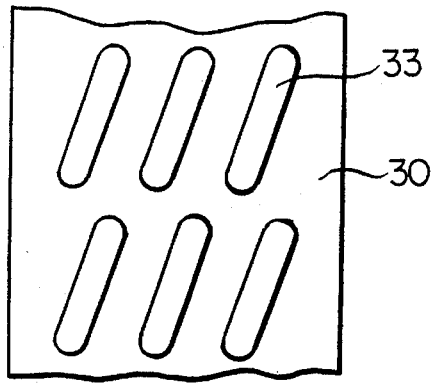
FIGS. 26 and 27 are a plan view and a cross-section of an anchor plate used in a ninth embodiment of this invention.
Figure 27:
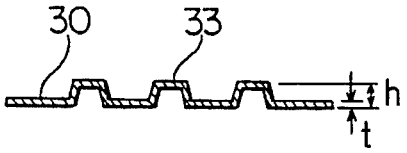

Next, FIGS. 26 and 27 are a plan view and a cross-section of the essential part of a ninth embodiment of this invention. By providing prolonged oval-shaped projecting beads 33, as shown in both figures, on the component members of the anchor plate 30, the height h of the anchor plate 30 is made larger than the thickness t of the component members thereof.

Figure 28:
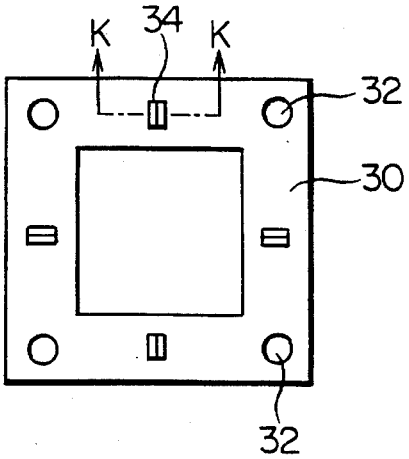
FIG. 28 is a plan view illustrating an anchor plate used in a tenth embodiment of this invention.
Figure 29:
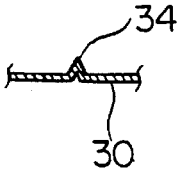
FIG. 29 is a cross-section taken along line K—K in FIG. 28.

FIG. 28 is a plan view illustrating an anchor plate used in a tenth embodiment of this invention, and FIG. 29 is a cross-section taken along line K—K in FIG. 29. Numeral 34 in both figures refers to a center mark; four center marks 34 provided at locations halving the distance between the two adjoining anchor bolt holes 32 for inserting anchor bolts (not shown). The center marks 34 can be provided when the anchor plate 30 is formed, and/or when the anchor bolt holes 32 are drilled. By providing these center marks 34, it becomes easy to position the anchor plate 30 by matching the center marks 34 with the marker line indicating the column center provided on the concrete subslab. The shape of the center mark 34 may be concave toward the upside, contrary to the shape shown in FIG. 29, and the cross-sectional shape thereof may be freely selected. Aside from the shape mentioned above, the center mark 34 may be provided by a punch or by marking.

Although the above embodiments employ the anchor plate 30 made of steel plate, the anchor plate 30 made of other structural materials than steel, including non-ferrous materials has the same effects. The projected plane shape of the anchor plate 30 may be other shapes than the quadrilateral, circular, cross shapes described above. The cross-sectional shape thereof is not limited to a U-shape, but may be a hollow square cylindrical, hollow cylindrical or any other geometrical shape so long as the height h of the anchor plate can be made larger than the thickness t of the component members thereof. Washers provided around the anchor bolt holes 32 may be omitted as necessary.

With the above construction, the weight of the anchor plate 30 having a predetermined rigidity can be reduced substantially, resulting in the ease of handling. In addition, this construction can reduce the thickness of the component members of the anchor plate, leading to reduced manufacturing costs.

ALTERNATIVE ARRANGEMENT OF ANCHOR BOLT ASSEMBLY

FIGS. 30 and 31 are front and plan views illustrating an eleventh embodiment of this invention, and FIG. 32 is a cross-section taken along line L—L in FIG. 30. Like parts are indicated by like numerals in FIG. 1 and FIGS. 11–14. In these figures, numeral 35 refers to a connecting member, made of an angle, both ends of which are bent at right angles and fastened to the upper and lower anchor plates 2 and 3 via bolts and nuts 36 to form an anchor bolt retainer 37. Next, the anchor bolts 4 are secured via through-holes (not shown) of predetermined dimensions and pitch, provided on each of the upper and lower anchor plates 2 and 3. The means for positioning the anchor bolts 4 on the lower anchor plate 3 by means of the washer plate 5 and the nuts is the same as in the embodiments shown in FIG. 1 and FIGS. 11–14. Next, four support members 26 made of angles, for example, are provided on the concrete subslab 7, and an anchor frame 38 is constructed by securing two horizontal members 29 made of angles on the upper ends of the support members 26 in such a manner that the top surface of the horizontal supports 29 forms a substantially horizontal plane. With the above-mentioned construction, the anchor bolts 4 can be embedded in the concrete foundation 8, together with the anchor bolt retainer 37 and the anchor frame 38, by placing the anchor bolt retainer 37 on the anchor frame 38, joining both together by bolts and nuts (not shown) or welding, and casting concrete.

ALTERNATIVE ARRANGEMENT OF SUPPORT ASSEMBLY AND ALTERNATIVE ARRANGEMENT WITH ANCHOR ASSEMBLY

FIGS. 33 and 34 are a front view and a plan view of the essential part of the anchor frame used in a twelfth embodiment of this invention. Like parts are indicated by like numerals in the embodiments shown in FIGS. 30 through 32. In FIG. 33, slots 39 extending in the vertical direction are provided in the vicinity of the upper ends of the support members 26 so as to permit bolts 40 to be passed through. With this construction, the top surface of the horizontal support members 29 can be levelled and the anchor bolts 4 shown in FIGS. 30 through 32 can be vertically positioned since the horizontal support members 29 can be moved in the vertical direction. Next, in FIG. 34, slots 41 and 42 are provided each on the lower anchor plate 3 and the horizontal support members 29 in an orthogonally intersecting manner so as to permit bolts 43 to be passed through. With this construction, the anchor bolts (not shown) passed through the through-holes **3*a* provided on the lower anchor plate 3 can be positioned horizontally since the lower anchor plate 3** can be moved on a horizontal plane.

In the above-mentioned embodiments, the anchor bolt retainer 37 is secured by bolts and nuts, but they can be secured at the erection site by welding, or a combination of both. The number of the connecting members 35 forming the anchor bolt retainer 37 is not limited to four, but may be selected appropriately taking into account the number of anchor bolts 4. In addition, the material used for the anchor bolt retainer 37 and the anchor frame 38 is not limited to angles, but other types of shape steels, tubes, rods, or any other structural materials, or a combination of these may be used. The support members 26 may be provided at predetermined locations on the concrete subslab 7 by inserting the members 26 into the unsolidified concrete 7.

With the above-mentioned construction, the following effects can be expected.

(1) Transportation is made quite easy since only component members fabricated in advance to predetermined dimensions at factory can be assembled at the construction site.

(2) The accuracy of the anchor bolt retainer 37 and the anchor frame 38 is substantially improved since virtually no deformation of the frame occurs partly because of few protruded portions on the frame, unlike the conventional one, and partly because of the ease of transportation as described in (1) above.

(3) The positioning accuracy of the anchor bolts 4 is substantially improved since the whole, or a part, of the component members can be joined together by bolts and nuts, and the anchor bolts 4 can be positioned at the erection site.

(4) As the anchor frame 38 can be installed extremely easily, there is no need at all for the use of special tools or cumbersome work that have hitherto been needed, resulting in a marked reduction in the manufacturing process.

TECHNIQUE FOR POSITIONING ANCHOR BOLT HOLES RELATIVE TO THE COLUMN BASE METAL FITTING AND STEEL FRAME COLUMN

Figure 35:
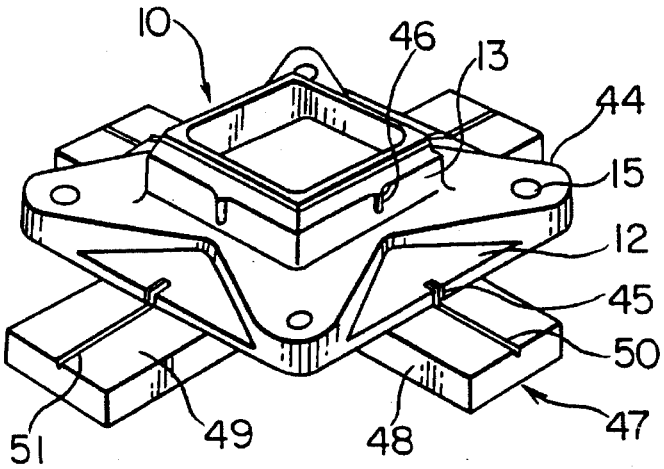
FIG. 35 is a perspective view illustrating the state where a column base metal fitting is placed on a machining jig in a thirteenth embodiment of this invention.

FIG. 35 is a perspective view of illustrating the state where the column base metal fitting used in a thirteenth embodiment of this invention is place on a machining jig. In FIG. 35, the column base metal fitting 10 has a square base plate 12 and a square raised portion 13. On the base plate 12 provided are thick portions at the four corners thereof. The raised portion 13 is a square projecting rim to which to which the steel frame column (not shown) is joined. As is evident from FIG. 35, marks 45 are provided in advance on the central points of the sides of the square base plate 12. The mark 45 indicated in the figure is a linear projection, but the column base metal fitting 10 of this invention is not limited to this shape, and the marks 45 may be of a spot-shaped projection, groove, recess or any other shape. Similar marks 46 are provided in advance on the central points of the sides of the square raised portion 13.

To provide anchor bolt holes 15 on the column base metal fitting 10 having these marks 45, the column base metal fitting 10 is first placed on a machining jig 47 of a machine tool having a center-aligning device, such as an NC machine tool. The machining jig 47 consists of tables 48 and 49, both extending in the X–Y direction and having center lines 50 and 51, respectively, so that center alignment can be automatically performed by matching the center lines 50 and 51 with the marks 45. Next, the anchor bolt holes 15 are automatically positioned on the thick portions 44 at the corners of the base plate 12, using an indexing device, and drilled. In this way, the anchor bolt holes 15 can be machined without marking operation.

Figure 36:
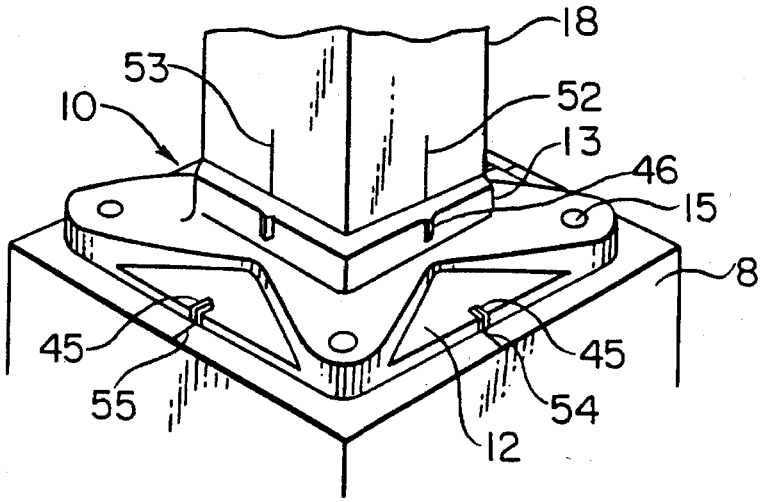
FIG. 36 is a perspective view illustrating the thirteenth embodiment of this invention.

FIG. 36 is a perspective view illustrating the state where the column base metal fitting 10, the steel frame column 18 and the concrete foundation are joined together in a thirteen embodiment of this invention. In joining the steel frame column 18 and the column base metal fitting 10 in FIG. 36, longitudinal center lines 52 and 53 are marked on the centers of the sides of the steel frame column 18, and the center lines 52 and 53 are matched with the marks 46 on the raised portion 13. Then, the steel frame column 18 is joined to the column base metal fitting 10 by welding, etc.

Furthermore, the use of the column base metal fitting 10 shown in FIG. 35 greatly facilitates the positioning on the concrete foundation 8. That is, the center lines 54 and 55 of the column are first marked on the concrete foundation 8, as shown in FIG. 36, and the center lines 54 and 55 are matched with the marks 45 of the base plate 12.

By using the column base metal fitting 10 having the above-mentioned construction, marking operation for proving mark lines on the base plate 12 and the raised portion 13 can be eliminated. Although this embodiment is concerned with a column base metal fitting supporting a column having a square cross section, the same applies to a column having a rectangular cross section.

FIG. 37 is a perspective view illustrating a column base metal fitting used in a fourteenth embodiment of this invention. The column base metal fitting 10 has an H-shaped steel frame column. In this embodiment, too, marks 45 and 46 are provided in advance on the central points of the sides of the base plate 22 and the raised portion 13, respectively.

FIG. 38 is a perspective view illustrating a column base metal fitting used in a fifteenth embodiment of this invention. The column base metal fitting 10 has a round raised portion 13 for supporting a round column, with marks 46 provided in advance on the outer periphery of the raised portion 13 at intervals of 90 degrees. The marks 45 are provided on the central points of the sides of the base plate 12, as in the above embodiment.

With this construction, the following effects can be expected.

(1) In machining the anchor bolt holes 15 on the column base metal fitting 10, the marking operation can be eliminated, leading to a reduction in the manufacturing cost of the column base metal fitting 10.

(2) By providing the marks 46 in advance on the raised portion 13, the marking operation for indicating the centers of the steel frame column 18 on the outer periphery of the raised portion 13 of the column base metal fitting 10 can be eliminated, leading to a reduction in manhours for the joining operation of the steel frame column 18.

(3) Furthermore, when the column base is installed on the concrete foundation 8 at the erection site, the steel frame column can be easily positioned by matching the centers on the column 18 provided on the concrete foundation 8 with the marks 45 on the base plate 12. This results in a reduction in manhours at the construction site.

ALTERNATIVE ARRANGEMENTS FOR MORTAR AIR VENT HOLES IN BASE METAL FITTING

FIGS. 39 and 40 are longitudinal section and partially cross-sectional plan views of a sixteenth embodiment of this invention. Like parts are indicated by like numerals shown in FIGS. 7 and 8. In FIGS. 39 and 40, the column base metal fitting 10 is made of cast steel, for example, and has a raised portion 13 having a plane corresponding to the profile of the end face of the foot of the steel frame column 18, which is integrally formed with a flat base plate 12. On the base plate 12 drilled are anchor bolt holes (not shown) at locations corresponding to the anchor bolts 4. The projected plane shape of the raised portion 13 and the base plate 12 is almost a square corresponding to the cross-sectional shape of the steel frame column 18. Numeral 56 are holes provided at locations almost corresponding to the contour of the central mortar 20 by piercing through the column base metal fitting 10.

The steel frame column 18 and the column base metal fitting 10 are joined together by welding to form the above-mentioned construction, and then positioned on the central mortar 20 provided in advance on the concrete foundation 8. After that, mortar 21 is cast into the form 23 in the direction shown by arrow C. In this case, the mortar 21 tends to flow, as shown in FIG. 8, entrapping the air in the neighborhood of the central mortar 20. Even if the air is entrapped, however, it can be easily discharged through the holes 56 provided on the column base metal fitting 10. Consequently, the mortar 21 can be cast without hindrance, ensuring perfect adhesion of the mortar 21 to the bottom surface of the column base metal fitting 10. Thus, the cavities 24 as shown in FIGS. 7 and 8 can be eliminated.

FIG. 41 is a partially cross-sectional plan view illustrating a seventeenth embodiment of this invention. Like parts are indicated by like numerals in FIGS. 39 and 40. In FIG. 41, numeral 57 refers to a groove provided in such a manner as to pierce through the central mortar 20 in the same direction as the mortar casting direction C and in the horizontal direction. The holes 56 should be provided on the column base metal fitting 10 in such a manner as to face the groove 57.

With this construction, as the mortar 21 is cast in the direction C, the mortar 21 not only flows in the same manner as described in the above-mentioned embodiments, but also flows into the groove (horizontal grooves) 57. The mortar flowing in the groove 57 passes through the groove 57 faster than the mortar flowing in other areas, reaching around the edge of the column base metal fitting 10. This prevents the air from being entrapped, ensuring perfect adhesion of the mortar 21 to the bottom surface of the column base metal fitting 10. Provision of the hole 56 facing the groove 57 permits the air entrapped during the casting or flowing of the mortar 21 in the groove 57 to be easily discharged.

FIG. 42 is a plan view of the mortar portion in an eighteenth embodiment of this invention. Like parts are indicated by like numerals in FIGS. 39 through 41. In FIG. 42, the central mortar 20 is formed into an elliptical planar shape in such a manner that the major axis of the ellipse lies in the direction of the casting and flowing of the mortar 21. Other arrangements are the same as with the above-mentioned embodiments.

With this construction, the steel frame column and the column base metal fitting (both not shown) are joined together and place on the central mortar 20, and the mortar 21 is cast in the direction C. In this case, the outside contour of the central mortar 21 almost coincides with the flow lines shown by arrows 58 because the central mortar 20 is formed into an elliptical planar shape, with the major axis thereof agreed with the mortar flowing direction. Thus, the mortar 21 encounters less fluidic resistance, and the turbulence of the mortar flow line can be prevented. This also eliminates the entrapping of the air in the mortar 21.

In the eighteenth embodiment, the cross-sectional shape of the steel frame column 18 and the planar shape of the column base metal fitting 10 are formed into an almost square shape. However, other quadrilateral, circular or any other geometrical shape than a square have the same effects. The column base metal fitting 10 may be formed not only by cast steel but also by steel plates or other steel materials. The hole 56 provided on the column base metal fitting 10 may be of other cross-sectional shapes than the circular shape used in this embodiment. The horizontal through-groove 57 provided on the central mortar 20 may be provided in multiple numbers. The planar shape of the central mortar 20 may be of any desired shapes, other than a square, or circular shape. When the horizontal groove is not provided, the central mortar 21 should have a shape whose contour includes a curve corresponding to the flow line of the mortar 21.

With this construction, the air existing between the column base metal fitting 10 and the concrete foundation 8 during the placement of the mortar 21 can be easily discharged through the hole 56 provided on the column base metal fitting 10, thus preventing the unwanted formation of cavities in the mortar 21.

RIGIDITY OF ANCHOR BOLTS

Figure 43:
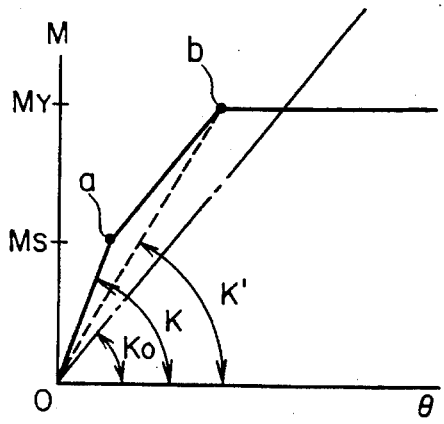
FIG. 43 is a diagram illustrating the behavior of rotative distortion caused by an external force applied to a column base structure in a nineteenth embodiment of this invention.
Figure 44:
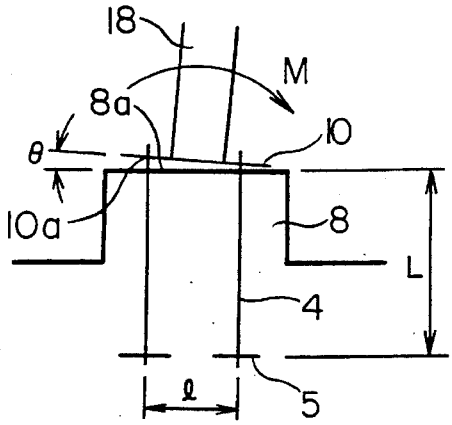
FIG. 44 is a schematic diagram of rotative distortion shown in FIG. 43.

FIG. 43 is a diagram illustrating the behavior of the rotative distortion of the column base structure caused by external force in a nineteenth embodiment of this invention. FIG. 44 is a schematic diagram of the same rotative distortion. In the nineteenth embodiment of this invention, the column base structure is joined together by introducing to anchor bolts 4 shown in FIG. 44 a tensile force 0.15–1.2 times as large as the yield point thereof in order to obtain a high rotative rigidity k, as shown in FIG. 43. This embodiment will be described in the following.

As noted earlier in the above embodiments, the column base structure of this invention is such that the rotative rigidity of the column base metal fitting 10 is so high that deformation can be reduced to a very low level, thus reducing the rotative distortion of the column base to almost zero. By giving a predetermined tensile force to the anchor bolts 4, together with the use of a column base metal fitting 10 having a high rotative rigidity, the rotative rigidity of the column base structure can be accurately evaluated.

According to experiments, the behavior of the rotative distortion of the column base structure of this embodiment caused by external force (bending moment) assumes a simplified form as shown by a solid line in FIG. 43. That is, the rotative rigidity (M/O) of the column base varies in three different sections: A section up to point a (in FIG. 43) where the bottom surface 10*a* of the column base metal fitting 10 at the location of the tensioned anchor bolt in FIG. 44 is separated from the top surface of the concrete foundation 8; a section up to point b (in FIG. 43) where the tensioned anchor bolt 4 yields; and a section thereafter.

The rotative rigidity indicated by an alternate long and short dash line in FIG. 43 is a theoretical value of the rotative rigidity in which the column base 10 is regarded as a perfect rigid body and no tensile force is introduced to the anchor bolt 4, and geometrically expressed by equation (1).

$$K_0 = \frac{E \cdot A_B \cdot l2}{L} \quad (1)$$

where $K_0$: rotative rigidity of column base when no tensile force is introduced to anchor bolts (tm/rad)

E: Young's modulus of anchor bolt (t/cm$^2$)

$A_B$: total cross-section area of the group of tensioned anchor bolts (cm$^2$)

l: distance between anchor bolts (cm)

L: effective insertion depth of anchor bolts (cm)

The rotative rigidity K in the section of O–a of the column base obtained in this case is (1+α) times as large as that obtained when no tensile force is introduced to anchor bolts 4, as indicated by equation (2). In this case, α is a spring constant ration of the anchor bolt 4 and the concrete foundation 8, given by equation (3).

$$K = (1 + \alpha)K_0 \quad (2)$$

$$\alpha = \frac{A_c}{n \cdot A_b} \quad (3)$$

where $A_c$: effective cross-sectional area of concrete foundation ($cm^2$)

$A_b$: cross-sectional area of anchor bolt ($cm^2$)

n: Young's modulus ratio of anchor bolt and concrete foundation

The (1+α) value is approximately 5–6 for commonly used SS41 and other anchor bolts. So, by introducing a tensile force to the anchor bolts 4 in the section O–a in FIG. 43, a substantially high rotative rigidity can be realized. In the section a–b in FIG. 43, however, as the bottom surface 10*a* of the column base metal fitting 10 is separated from the top surface 8*a* of the concrete foundation 8, the anchor bolts 4 are returned to the same state of simple tension as in the state where no tensile force is introduce. Thus, the rotative rigidity becomes the same value as $K_0$ in equation (1), a level lower than the level in the section O–a.

In the construction industry, the allowable yield strength of the column base is generally defined as the yield point value of the entire column base. The allowable yield strength of the column base therefore becomes the $M_y$ value (bending moment at which the anchor bolt 4 yields) shown in FIG. 43. Consequently, when the allowable yield strength of the column base is $M_y$, and the separating moment $M_s$ is lower than $M_y$, the rotative rigidity of the column base has to be evaluated as K', and it is difficult to maintain a high rotative rigidity K. In order to maintain a high rotative rigidity K, on the contrary, the allowable yield strength of the column base has to be evaluated from $M_y$ to $M_s$, posing a disadvantage in terms of yield strength.

In order to assure a high rotative rigidity and maintain a high allowable yield strength $M_y$ that is intrinsically possessed by the column base, therefore, $M_s$ should be equal to $M_y$. The separating moment $M_s$ relates to the value of tension introduced to the anchor bolts 4 and is given by equation (4).

$$M_S \approx T_0 \cdot l \quad (4)$$

where $T_0$: value of tension introduced to anchor bolts ($t/cm^2$)

l: distance between anchor bolts (cm)

The allowable yield strength of the column base is given by equation (5).

$$M_y \approx T_y \cdot l = \sigma_y \cdot A_B \cdot l \quad (5)$$

where $T_y$: yield tensile force of anchor bolts ($t/cm^2$)

$\sigma_y$: yield stress intensity of anchor bolts ($t/cm^2$)

To ensure $M_s = M_y$, therefore, $T_0$ should be such that $T_0 = T_y = \sigma_y \cdot A_B$. This is the best way to give full play to the performance of the anchor bolts 4 in terms of both allowable yield strength and rotative rigidity.

Consequently, the effects of introducing tension to the anchor bolts 4 are basically produced in a range of 0 to 1 times the yield stress of the anchor bolts 4.

It is known, however, that the tension introduced to the anchor bolts 4 is released by the drying shrinkage and creep of the concrete foundation 8.

Figure 45:
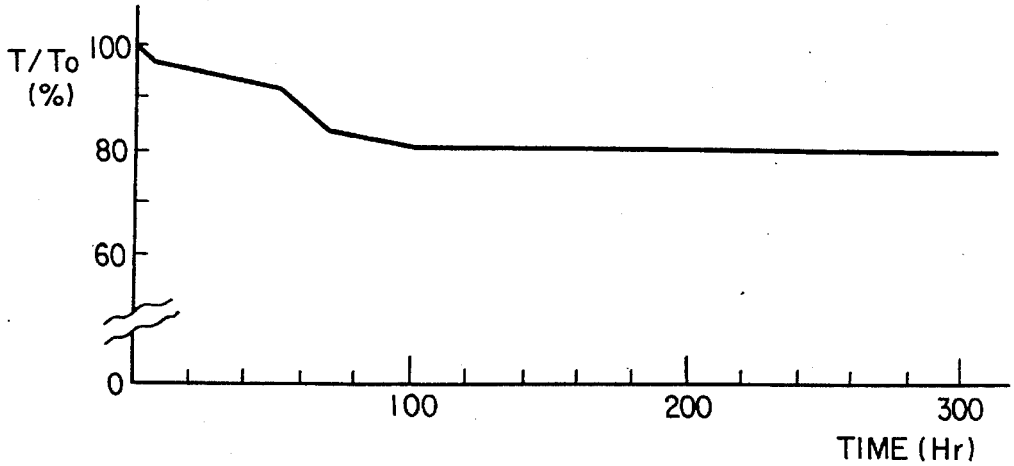
FIG. 45 is a diagram illustrating changes with time in the tensile force of an anchor bolt used in the nineteenth embodiment of this invention.

FIG. 45 shows the results of the anchor bolt tension unloading test the present application and others conducted.

Figure 48:
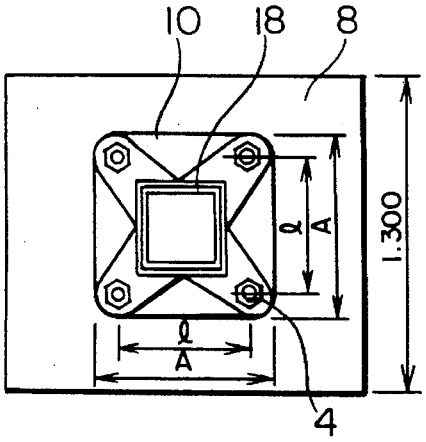
FIGS. 48 and 49 are a plan view and a longitudinal section illustrating a test piece in the nineteenth embodiment of this invention.
Figure 49:
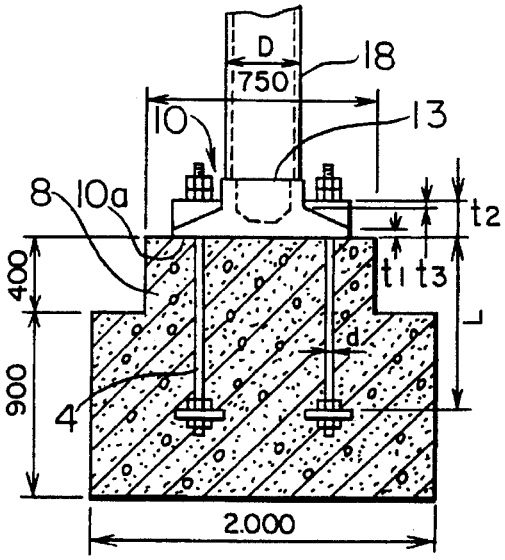

The test shown in FIG. 45 was conducted to investigate secular changes (the ratio of a tension T after the lapse of a predetermined time to the initially introduced tension $T_0$) in the tension of the anchor bolts 4 on a test piece (No. 5 test specimen which will be described later) corresponding to a steel-frame column base in an actual steel-frame building as shown in FIGS. 48 and 49, which will be described later.

This test revealed that the behavior of stress relaxation on the anchor bolts 4 has a certain regularity in the vicinity of the above-mentioned σy of the tension introduced. That is, when a tension is introduced to the anchor bolts 4 on a concrete foundation 8 which is more than 4 weeks old after placement, the stress relaxation is stabilized in about 4 days to approximately 20%. This shows good agreement with the required amount of retightening of the anchor bolts 4 in the lapse of the above period after the placement of the concrete foundation 8, a level that is normally experienced by those skilled in the art.

It follows from the above test results that by applying a tension of 1.2 $\sigma_y$ to the anchor bolts 4, the tension is eventually reduced to an ideal value of 1.0 σy after secular changes. For this reason, the upper limit of the introduced tension is set at 1.2 $\sigma_y$ in this embodiment.

Figure 46:
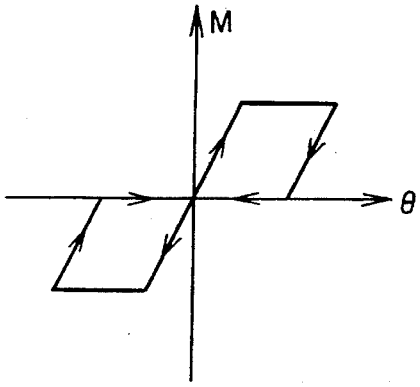
FIG. 46 (PRIOR ART)
FIG. 46 is a righting moment characteristic diagram for a conventional column base structure in which pretensioned anchor bolts are used.

The lower limit of the tension introduced to the anchor bolts 4 is set at 0.15 σy in this embodiment of the following reasons. It has been confirmed by a large number of experiment results that when the tension introduced to the anchor bolts 4 is 0, the column base shows a righting moment characteristic of the slip type as shown in FIG. 46. That is, wherever the positive/negative polarity of the bending moment generated in the column base is reversed, the column base trends to be subjected to a substantial rotative distortion even in the absence of a large bending moment. It is well known that this has an adverse effect on the superstructure.

Figure 47:
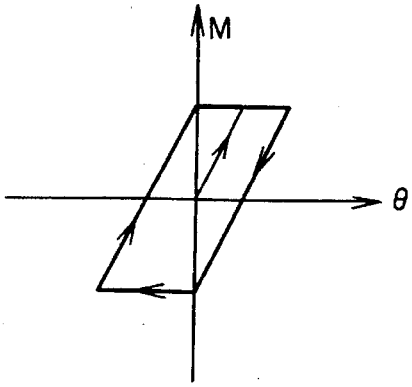
FIG. 47 is a righting moment characteristic diagram for a conventional column base structure used in the nineteenth embodiment of this invention.

In order to obtain a column base having a good performance (a spindle-shaped righting moment characteristic) as shown in FIG. 47, it is essential to prevent the tension introduced to the anchor bolts 4 from being completely released. It was found that when the tension introduced to the anchor bolts 4 is as low as 0.1–0.2 $\sigma_y$, the total stress relaxation in the anchor bolts 4 adds up to approximately 0.07 $\sigma_y$; consisting of approximately 0.05 $\sigma_y$ that is attributable to the drying shrinkage of the concrete foundation 8, and approximately 0.02 $\sigma_y$ that is attributable to the creep of the concrete foundation 8. As a result, when safety factor is set at about 2 and the introduced tension (stress intensity) is set at 0.15 $\sigma_y$, min., the tension introduced to the anchor bolts 4 is not completely released (with 0.08 $\sigma_y$ remaining) even after the lapse of time, and thus a good performance of the column base as shown in FIG. 47 can be ensured.

Consequently, the lower limit of the introduced tension (stress intensity) of anchor bolts is set at 0.15 $\sigma_y$ in this embodiment.

FIGS. 48 and 49 are a plan view and a longitudinal section illustrating a test specimen in a nineteenth embodiment of this invention. The measurement results of the rotative rigidity of the column base using this test specimen are shown in Table I. K0 in the table is the rotative rigidity of the conventional column base when no tension is applied to the anchor bolts 4. K is the rotative rigidity of the column base according to this invention

| | Dimensions (mm) | | | | | | | | Rotational regidity | | |
|---|---|---|---|---|---|---|---|---|---|---|---|
| No. | D | A | l | $t_1$ | $t_2$ | $t_3$ | d | L | $K_o$ tm/rad) | l + a | K(tm/rad) |
| 1 | 200 | 380 | 280 | 10 | 32 | 32 | 30 | 600 | $3.9 \times 10^3$ | 5 | $19.5 \times 10^3$ |
| 2 | " | " | " | " | " | " | 36 | 800 | $4.2 \times 10^3$ | " | $21.0 \times 10^3$ |
| 3 | 300 | 550 | 430 | 10 | 61 | 42 | 30 | 600 | $9.1 \times 10^3$ | 6 | $54.6 \times 10^3$ |
| 4 | " | " | " | " | " | " | 36 | 800 | $9.9 \times 10^3$ | " | $59.4 \times 10^3$ |
| 5 | " | " | " | " | " | " | 42 | 900 | $11.9 \times 10^3$ | " | $71.4 \times 10^3$ |

(Note) No. 5 is a test specimen used in the anchor bolt tension unloading test.

where tension is applied to the anchor bolts 4. As is evident from the table, the rotative rigidity K of the column base in this embodiment is as high as 5–6 times the rotative rigidity $K_0$ of the conventional column base.

The column base of this embodiment has a raised portion 12 on the column base metal fitting 10 for joining the steel-frame column 18 to prevent the strain caused by welding to the steel-frame column 18 from affecting the bottom surface 10*a* of the column base metal fitting 10.

The base portion of the column base structure is crowned by providing a slope from the base portion toward the edge portion to distribute the effects of the tension introduced to the anchor bolts 4 over the entire surface of the concrete foundation 8.

In addition, the use of a column base metal fitting 10 as disclosed in Japanese Patent Publication No. 47963/1976, 13642/1977, 43330/1977, or 30425/1981, etc., for example, could give full play to the above-mentioned effects.

As described above, since the tension (stress intensity) introduced to the anchor bolts 4 is set at 0.15–1.2 $\sigma_y$, the performance of the anchor bolts 4 can be fully utilized in terms of allowable yield strength, and the rotative rigidity of the column base can be evaluated at a high value. Furthermore, a good performance (spindle-shaped righting moment characteristic) for the positive/negative repetitive stress (bending moment generating in the column base) at an earthquake can also be maintained. In addition, by simplifying the dynamic mechanism of the column base, the performance (rotative rigidity and yield strength) of the column base can be accurately grasped, leading to increased safety of buildings.

Figure 50:
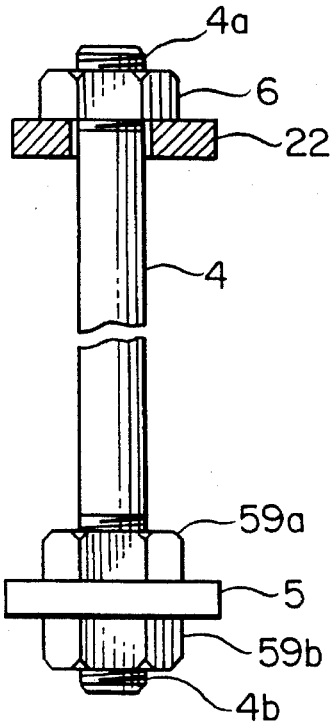
FIG. 50 is a partial cross-section illustrating an anchor bolt assembly used in a twentieth embodiment of this invention.
Figure 51:
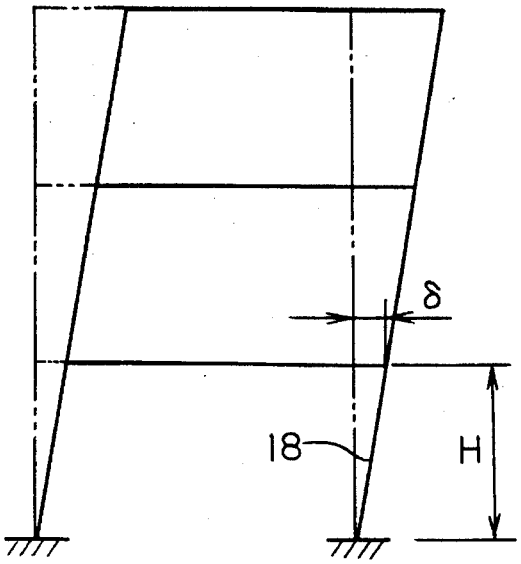
FIG. 51 is a diagram illustrating a story deformation of a building in the twentieth embodiment of this invention.

FIG. 50 is a partially cross-sectional side view of an anchor bolt assembly used in a twentieth embodiment of this invention. The anchor bolt assembly consists of an anchor bolt 4, a nut 6 screwed onto the upper threaded part 4*a* of the anchor bolt 4, a Flat washer 22 interposed between the nut 6 and an object being fastened (not shown), a pair of nuts 59*a* and 59*b* screwed onto the lower threaded part 4*b* of the anchor bolt 4, and a washer plate 5 held in place by the nuts 59*a* and 59*b*.

The anchor bolt 4 is made of a material having a tensile strength of 50–70 kg/mm$^2$; more specifically SS50, SS55, SR30, SRR40, SD30, SD35, SD40, SD50, S30C, S35C, S40C, S45C, S50C, or S55C. The flat washer 22 is made of a steel material for welded structures; more specifically SM50 or SMA50. The outside diameter of the flat washer 22 is more than 1.73 times as large as the outside diameter of the threaded part of the anchor bolt 4, and the thickness thereof is more than 0.13 times as large as the outside diameter of the threaded part of the anchor bolt 4. The inside diameter of the flat washer 22 should preferably be set at somewhere between the outside diameter of the threaded part of the anchor bolt 4 and the outside diameter thereof plus 2 mm. The nut 6 is desired to be made of the same material as the anchor bolt 4.

The nut 6 may be made of any of a steel material for general structures or that for welded structures, such as SS41, SM41 or SMA41. The height of the nut 6 may be about 0.92–1.40 times as large as the outside diameter of the threaded part of the anchor bolt 4.

With the above construction, the anchor bolt 4 can have a high tensile strength of 50–70 kg/mm$^2$, and the use of the flat washer 22 of SM50 or SMA50 permits the flat washer 22 to be properly welded to the column base metal fitting 10, ensuring a high shearing yield strength $Q_a$ in the column base. Thus, the shearing force Q generated in the steel-frame column 18 can be smoothly transmitted to the concrete foundation 8 via the column base metal fitting 10, the flat washer 22, and the anchor bolts 4.

Furthermore, the use of the flat washer having the above construction enables full-circle fillet welding. In this case, the use of the flat washer 22 whose outside diameter is more than 1.73 times the outside diameter of the threaded part of the anchor bolt 4 could cover the full-strength shearing yield strength $BQ_a$ of the times the outside diameter of the threaded part of the anchor bolt anchor bolt 4, as can be seen from the following calculations.

(1) Full-strength shearing yield strength $BQ_a$ of anchor bolt $$B_aQ = 0.75 \times \frac{\pi}{4} d^2 \times \frac{f_1}{\sqrt{3}} = 0.95\, d^2$$

where d: outside diameter of threaded part of anchor bolt $f_1$: yield point of anchor bolt 2.8 t/cm$^2$ (2) Shearing yield strength $_WQ_a$ of the fillet-welded part of the entire periphery of flat washer $$W_aQ = \pi D \times \frac{t}{\sqrt{2}} \times \frac{f_2}{\sqrt{3}} \approx 7.3\, td$$

where

D: outside diameter of flat washer≧1.73d t: thickness of flat washer $f_2$: allowable tensile stress intensity of fillet-welded part= 3.3t/cm$^2$ (3) Conditions where the shearing yield strength $_WQ_a$ of the fillet-welded part of the entire periphery of flat washer becomes larger than the full-strength shearing yield strength $_BQ_a$ of anchor bolt $$_BQ_a \leqq {}_WQ_a$$

$$\therefore 0.95d^2 \leqq 7.3td$$

$$\therefore t \geqq 0.13d$$

Moreover, according to a preferred embodiment of this invention, even when the column base is shifted sideways due to the shearing force Q exerted onto the column base, the amount of displacement is 4 mm at the maximum because the inside diameter of the flat washer 22 lies between the outside diameter of the threaded part of the anchor bolt 4 and the outside diameter thereof plus 2 mm. Consequently, assuming that the height of one story of a building is 3500 mm, which is a generally accepted value, the story deformation angle $\zeta$ (=$\delta$/H) obtained by dividing the horizontal displacement $\delta$ of the steel-frame column 18 for one story of the building by the height H of one story is approximately 1/875, a value that can satisfy the present legal standard of 1/200, as shown inn FIG. 51.

When the nut 6 is made of other material, as described above, the nut 6 has a yield strength equal to that of the anchor bolt 4. In addition, the nut 6 made of such a material can be full-circle welded to the flat washer 22. Although the nut 6 made of a weldable material has low mechanical properties (in terms of yield point and tensile strength), the nut 6 has a height 1.15–1.75 times the height of a nut specified in JIS and made of the same material as the anchor bolt 4 so that the nut 6 can have a strength, in the threaded part thereof and other parts, equal to that of a JIS standard nut made of the same material as the anchor bolt 4.

Substantiation of these values is as follows.

(1) Strength $T_a$ of the threaded part of a nut made of the same material as the anchor bolt $$T_a - Sn - S\frac{h_n}{p}$$

where

S: strength of the threads of a nut made of the same material as the anchor bolt n: number of threads of the nut $h_n$: height, specified by JIS, of the nut p: pitch of the nut (2) Strength $T_a'$ of the threaded part of a nut made of a steel for general structures $$Ta' = S'n' = S'\frac{h_n'}{p}$$

where

S': Strength of the threads of a nut made of a steel for general structures n': number of threads of the nut $h_n'$: height of the nut p: pitch of the nut (same as that of the nut in (1) above)

(3) Conditions where the strength of the threads of a nut made of a steel for general structures becomes equal to that of the nut made of the same material as the anchor bolt $$T_a = T_a'$$

$$\therefore S\frac{h_n}{p} = S'\frac{h_n'}{p} \quad \therefore h_n' = \frac{S}{S'}h_n$$

where S/S' is the ratio of the yield points of an anchor bolt and a nut made of a steel for general structures. With the combination used in this embodiment, this value is 1.15–1.75.

$$1.15h_n \leqq h_n' \leqq 1.75h_n$$

By using the anchor bolt assembly described above, and full-circle fillet-welding the flat washer 22 to the column base metal fitting 10, and the flat washer 22 to the nut 6, the full-strength shearing yield strength $Q_a$ of the anchor bolt 4 can be maintained in the column base, and the nut 6 can be prevented from loosening.

By assembling the anchor bolt assembly as described above aimed as fastening an object being fastened, and using the anchor bolt assembly in the column base of a steel-frame building, the following effects can be expected.

(1) The bending yield strength $M_a$ and shearing yield strength $Q_a$ can be increased simultaneously. (A tensile strength of 50–70 kg/mm$^2$ can be maintained for the anchor bolt, and at the same time, the full-strength shearing yield strength $_BQ_a$ of the anchor bolt can also be maintained.)

(2) The loosening of the anchor bolt having a tensile strength of 50–70 kg/mm$^2$ can be prevented.

This invention having the aforementioned construction and functions have the following effects.

(1) The anchor frame or the anchor bolt retainer can be assembled at the erection site by transporting the component members. This facilitates the transportation of component members, and ensures high accuracy in assembling the members, leading to improved positioning accuracy of the frame or the retainer with the anchor bolts.

(2) Because of a relatively few number of the component members involved, and of a simple overall construction, interference of the anchor frame with reinforcing bars embedded in the concrete foundation can be reduced.

(3) The column base structure is hardly subjected to deformation due to the flow of concrete during placement of the concrete foundation, making it possible to center align the anchor bolts with high accuracy.

(4) Connection of the anchor bolts to the upper anchor plate without the use of an anchor-bolt covering sleeve helps improve the anchoring accuracy of the anchor bolts.

(5) By providing marks in advance on the outer periphery of the base plate of the column base metal fitting, the marking operation for machining anchor bolt holes on the column base metal fitting can be eliminated. This leads to reduced manufacturing cost of the column base metal fitting.

(6) By providing marks in advance on the raised portion of the column base metal fitting, the marking operation to indicate the center of the steel-frame column can be eliminated in welding the steel-frame column to the column base metal fitting. This leads to reduced manhours in joining the steel-frame column.

(7) During on-the-site installation of the column base on the concrete foundation, positioning of the column base can be facilitated by matching the marks indicating the center of the steel-frame column provided on the concrete foundation with the corresponding marks provided on the base plate. This results in a reduction in manhours at the construction site.

(8) By providing vertical through holes in the outer contour of the raised portion of the column base metal fitting, the air is prevented from being entrapped during casting mortar into the gap between the column base metal fitting and the concrete foundation. Thus, cavities caused by the entrapped air can be completely eliminated. As a result, the mortar can perfectly adhere to the bottom surface of the column base metal fitting, leading to a substantial improvement in the aseismic performance required of the column base structure.

(9) By setting the tension (stress intensity) introduced to the anchor bolts to 0.15–1.2 $\sigma_y$, the allowable yield strength of the anchor bolts can be fully utilized, and a higher rotative rigidity of the column base can be guaranteed.

(10) A good performance (spindle-shaped righting moment characteristic) can be maintained against the positive/negative repetitive stress (bending moment generated in the column base) at the time of an earthquake.

(11) By simplifying the dynamic mechanism of the column base, the performance (rotative rigidity and yield strength) of the column base can be accurately grasped. This leads to increased safety of the building.

(12) By interposing a flat washer of a predetermined size between the column base metal fitting and the nut, the bending yield strength and shearing yield strength of the column base can be increased simultaneously.

While specific embodiments of the invention have been shown and described in detail to illustrate the application of the principles of the invention, it will be understood that the invention may be embodied otherwise without departing from such principles.

What is claimed is:

1. A column base structure formed by the steps of:

fixedly fitting support members to a concrete subslab such that said support members project upwardly from said concrete subslab;

fixedly fitting horizontal support members to upper ends of said support members;

forming an anchor bolt assembly including anchor bolts, an upper anchor plate and a lower anchor plate by connecting said upper anchor plate to upper ends of a plurality of anchor bolts, connecting said lower anchor plate to lower ends of said plurality of anchor bolts, said anchor bolts each having threaded parts at said upper ends and fixing said anchor plates to said anchor bolts by engaging nuts with said threaded parts;

welding a lower part of said anchor bolt assembly to said horizontal support members of said support assembly;

pouring a concrete foundation around said support assembly and said anchor bolt assembly to a level below said upper anchor plate and above said lower anchor plate.

* * * * *